US008521073B2

(12) United States Patent
Kubo et al.

(10) Patent No.: US 8,521,073 B2
(45) Date of Patent: Aug. 27, 2013

(54) INTERMEDIATE TRANSFER MEMBER AND IMAGE FORMING APPARATUS USING THE SAME

(75) Inventors: Hidetaka Kubo, Kanagawa (JP); Jun Aoto, Kanagawa (JP); Kenichi Mashiko, Kanagawa (JP); Shinichi Nitta, Miyagi (JP); Sayaka Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 13/239,528

(22) Filed: Sep. 22, 2011

(65) Prior Publication Data

US 2012/0082488 A1 Apr. 5, 2012

(30) Foreign Application Priority Data

Oct. 1, 2010 (JP) ..... 2010-224340

(51) Int. Cl.
*G03G 15/01* (2006.01)

(52) U.S. Cl.
USPC ..... 399/302; 399/303; 399/308

(58) Field of Classification Search
USPC ..... 399/121, 162, 297, 302, 303, 308; 430/66, 125.32
See application file for complete search history.

(56) References Cited

U.S. PATENT DOCUMENTS

| | | | | |
|---|---|---|---|---|
| 7,593,676 | B2 * | 9/2009 | Katoh | 399/302 |
| 7,865,091 | B2 * | 1/2011 | Watanabe et al. | 399/27 |
| 7,917,071 | B2 * | 3/2011 | Hirai et al. | 399/308 |

FOREIGN PATENT DOCUMENTS

| | | |
|---|---|---|
| JP | 9-230717 | 9/1997 |
| JP | 2002-162767 | 6/2002 |
| JP | 2007-328165 | 12/2007 |
| JP | 2009-75154 | 4/2009 |
| JP | 4430892 | 12/2009 |

* cited by examiner

*Primary Examiner* — Hoan Tran
(74) *Attorney, Agent, or Firm* — Cooper & Dunham LLP

(57) ABSTRACT

An intermediate transfer member including a base layer as first layer, an elastic layer as second layer, and a particle layer as third layer and containing fine spherical particles arranged in plane direction thereof where the particle layer has a concavo-convex pattern formed by the fine spherical particles, the elastic layer and the particle layer being formed on the base layer in this order, wherein the intermediate transfer member has a Martens hardness of 1.0 N/mm$^2$ or lower and an elastic recovery rate of 75% or higher when the intermediate transfer member is indented at a load of 40 mN under conditions of 25° C. and 50% RH, wherein an embedment rate of the fine spherical particles in the elastic layer is 33% to 99%, and wherein the intermediate transfer member is configured to receive a toner image formed by developing, with a toner, a latent image on an image bearing member.

8 Claims, 2 Drawing Sheets

INTERMEDIATE TRANSFER MEMBER AND IMAGE FORMING APPARATUS USING THE SAME

BACKGROUND OF THE INVENTION

1. Field of the Invention

The present invention relates to an image forming apparatus suitably used for electrophotographic apparatuses such as copiers, printers and facsimiles; and to an intermediate transfer member used for the image forming apparatus.

2. Description of the Related Art

In general, the image forming apparatus performs a process including: forming a latent electrostatic image on a charged surface of a photoconductor based on an image obtained by an image information reader; developing the latent electrostatic image with a developing device to form a toner image; electrostatically transferring the toner image onto an intermediate transfer member (primary transfer); transferring again the toner image from the intermediate transfer member to a recording medium (a transfer medium) (secondary transfer); and fixing under heating the toner image with a fixing roller or a fixing belt.

A seamless belt has been used as the above intermediate transfer member. Particularly, in full-color image forming apparatuses of recent years, an intermediate transfer belt system is used, in which developed images of four colors: yellow, magenta, cyan and black, are superposed on an intermediate transfer medium (seamless belt) and then the superposed image is collectively transferred to a transfer medium such as paper.

However, in such an intermediate transfer belt system, four developing devices are used for one photoconductor. Such an intermediate transfer belt system has a disadvantage that printing speed is low.

For a system capable of attaining high speed printing, a four-series tandem system is used in which photoconductors for four colors are arranged in a tandem manner, and each color is continuously transferred on paper.

However, in this four-series tandem system, it is quite difficult to achieve sufficient positional accuracy upon superposing respective images because of changes of conditions of paper due to the working environments, forming images where the color images are not accurately superposed on top of each other.

Thus, recently, an intermediate transfer system has been predominately applied in the four-series tandem system.

Under such circumstances, characteristics required for the intermediate transfer belt have become strict to achieve, such as positional accuracy at high-speed transfer, material thereof, etc., but it is necessary to satisfy those characteristics. Regarding the positional accuracy, it is required to inhibit variation in positional accuracy caused by deformation such as elongation of a belt itself due to continuous use. Regarding the material of the intermediate transfer belt, it is required to be flame retardant, since the intermediate transfer belt occupies a large area of an apparatus and a high voltage is applied thereto for transferring an image.

In order to satisfy these requirements, there have been used a polyimide resin and a polyamideimide resin, which are highly elastic and highly heat resistant, as the material of an intermediate transfer belt.

However, an intermediate transfer belt made of a polyimide resin has high strength and thus high surface hardness. Therefore, in transferring a toner image, a high pressure is applied to the toner layer. As a result, the toner particles are locally aggregated, resulting in that part of the image is not transferred in some cases to form a so-called spot-containing image. Also, such an intermediate transfer belt has poor followability to a photoconductor, paper, etc., which are brought into contact with the intermediate transfer belt at transfer positions. Such poor followability may cause insufficient contact portions (spaces) at the transfer positions, leading to uneven transfer.

In recent years, full-color electrophotographic image formation has increasingly been performed on various types of paper, such as commonly-used smooth paper, highly-smooth papers with slip properties (e.g., coated papers) and rough paper (e.g., recycled paper, embossed paper, Japanese paper and kraft paper). In the full-color electrophotographic image formation, followability to such papers that have various surface conditions is important. Poor followability causes unevenness in image density and color toner following irregularities of paper. Thus, there is a need to provide an intermediate transfer belt having excellent followability to paper having different surface conditions.

In order to solve this problem, various intermediate transfer belts have been proposed which contain a base layer and a relatively flexible layer laminated on the base layer.

However, when the relatively flexible layer is used as a surface layer, the pressure during transfer may be reduced. In addition, although the followability to irregularities of paper is improved, toner particles cannot successfully be separated from the surface layer since the toner releaseability of the surface is poor. As a result, the transfer efficiency is decreased while the followability is improved. Furthermore, such a surface layer is problematically degraded in wear resistance and abrasion resistance.

In order to solve these various problems relating to the intermediate transfer belt, intermediate transfer belts each further containing a protective layer have been provided. The protective layer made of a material having sufficiently high transferability cannot comply with the underlying flexible layer and is unfavorably cracked or peeled off. In view of this, it has been proposed that fine particles are attached onto the surface of the intermediate transfer belt (see, for example, Japanese Patent Application Laid-Open (JP-A) Nos. 09-230717, 2002-162767, 2004-354716, 2007-328165 and 2009-75154).

For example, there has been proposed that the surface of an intermediate transfer belt is coated with beads having a diameter of 3 μm or smaller (see, for example, JP-A No. 09-230717).

However, in the technique proposed in this patent literature, the particles tend to be exfoliated. Thus, this technique is not sufficient to achieve the durability required for the recent electrophotographic apparatuses.

Also, there has been proposed that a layer is formed on the surface of an intermediate transfer belt from a material having an affinity to hydrophobidized fine particles, where particles having a very small particle diameter are preferably used (see, for example, JP-A Nos. 2002-162767 and 2004-354716).

However, in the technique proposed in these patent literatures, the particle layer is thick and has ununiform areas formed due to aggregation of the particles, causing variation in transferability. Thus, this technique is not sufficient to achieve the formation of high-quality images required for the recent electrophotographic apparatuses.

Moreover, there has been proposed that relatively large particles are partially embedded in the resin to realize satisfactory durability as well as satisfactory transferability (see, for example, JP-A Nos. 2007-328165 and 2009-75154).

However, even in this proposal, the particles are ununiformly present in the layer. This technique is still not sufficient to achieve the formation of high-quality images required for the recent electrophotographic apparatuses.

In any of the techniques disclosed in JP-A Nos. 09-230717, 2002-162767, 2004-354716, 2007-328165 and 2009-75154, silica particles are preferably used. The silica particles are strongly aggregated together to fail to form a uniform particle layer, resulting in that the particles tend to be exfoliated.

In view of this, in order to prevent the particles from being exfoliated, there has been proposed that an adhesion layer, etc. is formed as an underlying layer on the surface of an intermediate transfer belt.

However, in this proposal, the adhesion layer is quite poor in toner releaseability and thus, toner particles adhere to the "exposed adhesion layer" present the gaps between the particles (filming), causing a cleaning failure. Furthermore, such inorganic particles as silica tend to scratch and abrade the surface of an organic photoconductor, which is suitably used as a latent electrostatic image bearing member responsible for image formation, when comes into contact with the organic photoconductor at the transfer position, causing a failure of degrading durability thereof.

Therefore, there have still not been provided intermediate transfer members that achieve the formation of high-quality images required for the recent image forming apparatuses. Thus, at present, keen demand has arisen for such intermediate transfer members.

BRIEF SUMMARY OF THE INVENTION

The present invention has been made in view of the foregoing, and aims to solve the above existing problems and achieve the following objects. That is, an object of the present invention is to provide an intermediate transfer member which has flexibility, which is excellent in releaseability to toner, which realizes high transfer performance regardless of the type of a transfer medium and surface conditions thereof, which involves no exfoliation of particles for a long period of time, which does no damage to an organic photoconductor, and which can stably form high-quality images; and an image forming apparatus using the intermediate transfer member.

The present inventors conducted extensive studies to achieve the above objects, and have found that an intermediate transfer member including: a base layer serving as a first layer; an elastic layer serving as a second layer; and a particle layer serving as a third layer and containing fine spherical particles arranged in a plane direction of the particle layer where the particle layer has a concavo-convex pattern formed by the fine spherical particles, the elastic layer and the particle layer being formed on the base layer in this order, wherein the intermediate transfer member has a Martens hardness of 1.0 $N/mm^2$ or lower and an elastic recovery rate of 75% or higher when the intermediate transfer member is indented at a load of 40 mN under conditions of 25° C. and 50% RH, wherein an embedment rate of the fine spherical particles in the elastic layer is 33% to 99%, and wherein the intermediate transfer member is configured to receive a toner image formed by developing, with a toner, a latent image on an image bearing member, has flexibility, is excellent in releaseability to toner, realizes high transfer performance regardless of the type of a transfer medium and surface conditions thereof, involves no exfoliation of particles for a long period of time, does no damage to an organic photoconductor, and can stably form high-quality images. The present invention has been accomplished on the basis of this finding.

The present invention is based on the above finding obtained by the present inventors. Means for solving the above problems are as follows.

<1> An intermediate transfer member including:

a base layer serving as a first layer, an elastic layer serving as a second layer, and a particle layer serving as a third layer and containing fine spherical particles arranged in a plane direction of the particle layer where the particle layer has a concavo-convex pattern formed by the fine spherical particles, the elastic layer and the particle layer being formed on the base layer in this order, wherein the intermediate transfer member has a Martens hardness of 1.0 $N/mm^2$ or lower and an elastic recovery rate of 75% or higher when the intermediate transfer member is indented at a load of 40 mN under conditions of 25° C. and 50% RH, wherein an embedment rate of the fine spherical particles in the elastic layer is 33% to 99%, and wherein the intermediate transfer member is configured to receive a toner image formed by developing, with a toner, a latent image on an image bearing member.

<2> The intermediate transfer member according to <1>, wherein the fine spherical particles are silicone particles.

<3> The intermediate transfer member according to <1> or <2>, wherein the fine spherical particles have a volume average particle diameter of 0.5 μm to 5.0 μm.

<4> The intermediate transfer member according to any one of <1> to <3>, wherein the elastic layer is formed of at least one rubber material selected from an elastomer and a rubber.

<5> The intermediate transfer member according to any one of <1> to <4>, wherein the elastic layer has a thickness of 200 nm to 2,000 μm.

<6> The intermediate transfer member according to any one of <1> to <5>, wherein the base layer is formed of at least one selected from a polyimide resin and a polyamideimide resin.

<7> An image forming apparatus including:

an image bearing member configured to form a latent image thereon and bear a toner image, a developing unit configured to develop with a toner the latent image formed on the image bearing member to form the toner image, an intermediate transfer member onto which the toner image developed with the developing unit is primarily transferred, and a transfer unit configured to secondarily transfer onto a recording medium the toner image transferred onto the intermediate transfer member, wherein the intermediate transfer member is the intermediate transfer member according to any one of <1> to <6>.

<8> The image forming apparatus according to <7>, wherein the image forming apparatus is a full-color image forming apparatus where a plurality of the image bearing members each having the developing unit for each color are arranged in series.

The present invention can provide an intermediate transfer member which has flexibility, which is excellent in releaseability to toner, which realizes high transfer performance regardless of the type of a transfer medium and surface conditions thereof, which involves no exfoliation of particles for a long period of time, which does no damage to an organic photoconductor, and which can stably form high-quality images; and an image forming apparatus using the intermediate transfer member. These can solve the above existing problems.

Figure 1:
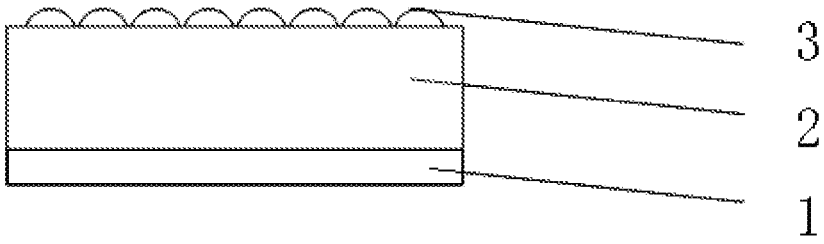
FIG. 1 is an explanatory view of one surface structure of an intermediate transfer member of the present invention.

DETAILED DESCRIPTION OF THE INVENTION (Intermediate Transfer Member)

An image forming apparatus of the present invention uses seamless belts (endless belts) as several members. One seamless belt required for electrical characteristics is an intermediate transfer member (intermediate transfer belt). The intermediate transfer member is suitably used as an intermediate transfer belt of an image forming apparatus employing an intermediate transfer belt system, in which a plurality of developed color toner images are sequentially formed on an image bearing member (e.g., a photoconductor drum) and then sequentially superposed on top of each other on an intermediate transfer belt to perform primary transfer, and the resultant primarily transferred image is secondarily transferred onto a recording medium at one time.

The intermediate transfer member has a laminated structure containing at least a base layer (first layer), an elastic layer (second layer) and a particle layer (third layer) sequentially laminated; and, if necessary, further containing a protective layer, an intermediate layer and other layers.

<Base Layer>

The base layer contains at least a resin; and, if necessary, further contains other ingredients.

<<Resin>>

The resin is not particularly limited and may be appropriately selected depending on the intended purpose. Examples thereof include fluorine resins such as PVDF and ETFE, polyimide resins and polyamideimide resins. These may be used alone, or in combination of two or more appropriately selected considering compatibility therebetween. Also, the resin may be a copolymer having a polyimide repeating unit and a polyamideimide repeating unit.

Of these, fluorine resins such as PVDF and ETFE are preferred since they are excellent in flame retardancy, and polyimide resins and polyamideimide resins are preferred since they are excellent in mechanical strength (high elasticity) and heat resistance to stably form high-quality images.

—Polyimide Resin—

The polyimide resin (hereinafter may be referred to simply as "polyimide") is not particularly limited and may be appropriately selected depending on the intended purpose, but aromatic polyimides are preferred since they are excellent in mechanical strength.

—Synthesis Method for Polyimide Resin—

The synthesis method for the polyimide resin is not particularly limited and may be appropriately selected depending on the intended purpose. Examples thereof include a method in which the polyimide resin is synthesized via a polyimide precursor which is obtained by reacting an aromatic polycarboxylic anhydride (or a derivative thereof) with an aromatic diamine.

In particular, the aromatic polyimide has a stiff main chain, and is insoluble in a solvent and is not melted. Thus, in the above synthesis method for the polyimide resin, at first, an aromatic polycarboxylic anhydride is reacted with an aromatic diamine so as to synthesize a polyimide precursor (i.e., a polyamic acid or polyamide acid) which is soluble in an organic polar solvent. The thus-synthesized polyamic acid is molded by various methods, followed by dehydration/cyclization (i.e., imidization) upon application of heat thereto or using a chemical method, to thereby synthesize a polyimide resin.

Taking as an example a reaction for obtaining the aromatic polyimide, the outline thereof is shown in the following Reaction Scheme (1).

Reaction Scheme (1)

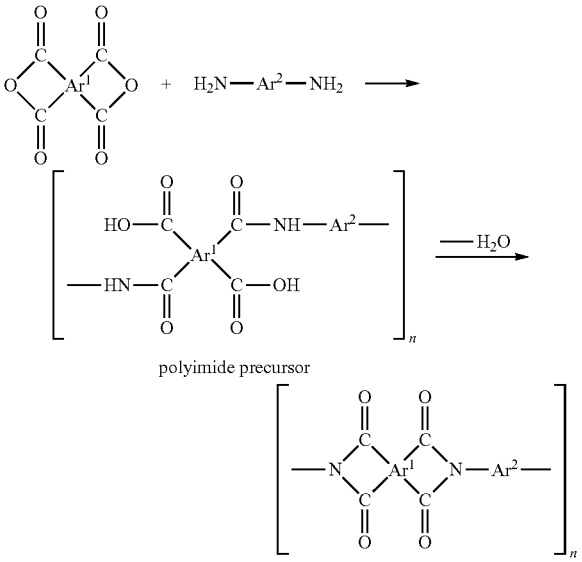

In Reaction Scheme (1), $Ar^1$ denotes a tetravalent aromatic residue containing at least one six-membered carbon ring; and $Ar^2$ denotes a divalent aromatic residue containing at least one six-membered carbon ring.

—Aromatic Polycarboxylic Anhydride—

The aromatic polycarboxylic anhydride is not particularly limited and may be appropriately selected depending on the intended purpose. Examples thereof include ethylenetetracarboxylic dianhydride, cyclopentanetetracarboxylic dianhydride, pyromellitic dianhydride, 3,3',4,4'-benzophenonetetracarboxylic dianhydride, 2,2',3,3'-benzophenonetetracarboxylic dianhydride, 3,3',4,4'-biphenyltetracarboxylic dianhydride, 2,2',3,3'-biphenyltetracarboxylic dianhydride, 2,2-bis(2,3-dicarboxyphenyl)propane dianhydride, bis(3,4-dicarboxyphenyl)ether dianhydride, bis(3,4-dicarboxyphenyl)sulfone dianhydride, 1,1-bis(2,3-dicarboxyphenyl)ethane dianhydride, bis(2,3-dicarboxyphenyl)methane dianhydride, bis(3,4-dicarboxyphenyl)methane dianhydride, 2,2-bis(3,4-dicarboxyphenyl)-1,1,1,3,3,3-hexafluoropropane dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 1,2,3,4-benzenetetracarboxylic dianhydride, 3,4,9,10-perylenetetracarboxylic dianhydride, 2,3,6,7-anthracenetetracarboxylic dianhydride, and 1,2,7,8-phenanthrenetetracarboxylic dianhydride. These may be used alone or in combination.

—Aromatic Diamine—

The aromatic diamine is not particularly limited and may be appropriately selected depending on the intended purpose.

Examples thereof include m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, bis(3-aminophenyl)sulfide, (3-aminophenyl)(4-aminophenyl)sulfide, bis(4-aminophenyl)sulfide, bis(3-aminophenyl)sulfide, (3-aminophenyl)(4-aminophenyl)sulfoxide, bis(3-aminophenyl)sulfone, (3-aminophenyl)(4-aminophenyl)sulfone, bis(4-aminophenyl)sulfone, 3,3'-diaminobenzophenone, 3,4'-diaminobenzophenone, 4,4'-diaminobenzophenone, 3,3'-diaminodiphenylmethane, 3,4'-diaminodiphenylmethane, 4,4'-diaminodiphenylmethane, bis[4-(3-aminophenoxy)phenyl]methane, bis[4-(4-aminophenoxy)phenyl]methane, 1,1-bis[4-(3-aminophenoxy)phenyl]ethane, 1,1-bis[4-(4-aminophenoxy)phenyl]ethane, 1,2-bis[4-(3-aminophenoxy)phenyl]ethane, 1,2-bis[4-(4-aminophenoxy)phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy)phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,3-bis(4-aminophenoxy)benzene, 1,4-bis(3-aminophenoxy)benzene, 1,4-bis(4-aminophenoxy)benzene, 4,4'-bis(3-aminophenoxy)biphenyl, 4,4'-bis(4-aminophenoxy)biphenyl, bis[4-(3-aminophenoxy)phenyl]ketone, bis[4-(4-aminophenoxy)phenyl]ketone, bis[4-(3-aminophenoxy)phenyl]sulfide, bis[4-(4-aminophenoxy)phenyl]sulfide, bis[4-(3-aminophenoxy)phenyl]sulfoxide, bis[4-(4-aminophenoxy)phenyl]sulfoxide, bis[4-(3-aminophenoxy)phenyl]sulfone, bis[4-(4-aminophenoxy)phenyl]sulfone, bis[4-(3-aminophenoxy)phenyl]ether, bis[4-(4-aminophenoxy)phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy)benzoyl]diphenyl ether, 4,4'-bis[4-(4-amino-α,α-dimethylbenzyl)phenoxy]benzophenone, 4,4'-bis[4-(4-amino-α,α-dimethylbenzyl)phenoxy]diphenyl sulfone, bis[4-{4-(4-aminophenoxy)phenoxy}phenyl]sulfone, 1,4-bis[4-(4-aminophenoxy)phenoxy]-α,α-dimethylbenzyl]benzene and 1,3-bis[4-(4-aminophenoxy)-α,α-dimethylbenzyl]benzene. These may be used alone or in combination.

Of these, 4,4'-diaminodiphenyl ether is preferred from the viewpoint of effectively exhibiting physical properties of the intermediate transfer member of the present invention.

—Organic Polar Solvent—

The organic polar solvent is not particularly limited and may be appropriately selected depending on the intended purpose. Examples thereof include sulfoxide solvents, formamide solvents, acetamide solvents, pyrrolidone solvents, phenol solvents, ether solvents, alcohol solvents, ester solvents, cellosolve solvents, hexamethylphosphoramide and γ-butyrolactone hexamethyl. These may be used alone or in combination.

The sulfoxide solvent is not particularly limited and may be appropriately selected depending on the intended purpose. Examples thereof include dimethylsulfoxide and diethylsulfoxide.

The formamide solvent is not particularly limited and may be appropriately selected depending on the intended purpose. Examples thereof include N,N-dimethylformamide and N,N-diethylformamide.

The acetamide solvent is not particularly limited and may be appropriately selected depending on the intended purpose. Examples thereof include N,N-dimethylacetamide and N,N-diethylacetamide.

The pyrrolidone solvent is not particularly limited and may be appropriately selected depending on the intended purpose. Examples thereof include N-methyl-2-pyrrolidone and N-vinyl-2-pyrrolidone.

The phenol solvent is not particularly limited and may be appropriately selected depending on the intended purpose. Examples thereof include phenol, o-, m- or p-cresol, xylenol, halogenated phenol and catechol.

The ether solvent is not particularly limited and may be appropriately selected depending on the intended purpose. Examples thereof include tetrahydrofuran, dioxane and dioxolane.

The alcohol solvent is not particularly limited and may be appropriately selected depending on the intended purpose. Examples thereof include methanol, ethanol and butanol.

The cellosolve solvent is not particularly limited and may be appropriately selected depending on the intended purpose. Examples thereof include butyl cellosolve.

Of these, N,N-dimethylacetamide and N-methyl-2-pyrrolidone are preferred since they exhibit high dissolution capability to give suitable polymerization conditions.

—Polyimide Precursor—

The polyimide precursor is not particularly limited and may be appropriately selected depending on the intended purpose. It may be, for example, an appropriately synthesized product or a commercially available product.

The method for synthesizing the polyimide precursor is not particularly limited and may be appropriately selected depending on the intended purpose. One employable method for synthesizing the polyimide precursor is as follows. Specifically, in an inert gas (such as argon gas and nitrogen gas) environment, an aromatic polycarboxylic anhydride or a derivative thereof and an aromatic diamine are polymerized at about equimolar in an organic polar solvent to induce ring opening polymerization-addition reaction involving heat generation, and as a result the viscosity of the solution rapidly increases, to thereby produce a polyimide precursor solution containing a high-molecular-weight polyamic acid uniformly dissolved in the organic polar solvent.

The order in which the aromatic polycarboxylic anhydride or derivative thereof and the diamine used for synthesizing the polyimide precursor is not particularly limited and may be appropriately selected depending on the intended purpose. Examples thereof include an order in which the diamine and the aromatic polycarboxylic anhydride or derivative thereof are added in this order in the organic polar solvent, an order in which the aromatic polycarboxylic anhydride or derivative thereof and the diamine are added in this order in the organic polar solvent, and an order in which the aromatic polycarboxylic anhydride or derivative thereof and the diamine are added at the same time in the organic polar solvent.

The state of the diamine, the aromatic polycarboxylic anhydride or the derivative thereof used for synthesizing the polyimide precursor is not particularly limited and may be appropriately selected depending on the intended purpose. The diamine, the aromatic polycarboxylic anhydride or the derivative thereof is, for example, in the form of solid, solution (in which it is dissolved in the organic polar solvent) or slurry.

The reaction time for the synthesis of the polyimide precursor is not particularly limited and may be appropriately selected depending on the intended purpose. It is, for example, about 30 min to about 12 hours.

The reaction temperature for the synthesis of the polyimide precursor is not particularly limited and may be appropriately selected depending on the intended purpose. It is preferably −20° C. to 100° C., particularly preferably 60° C. or lower.

The commercially available product of the polyimide precursor is not particularly limited and may be appropriately selected depending on the intended purpose. Examples thereof include a commercially available product of a so-called polyimide varnish, in which a polyamic acid composition is dissolved in an organic solvent.

The commercially available product of the polyimide varnish is not particularly limited and may be appropriately selected depending on the intended purpose. Examples thereof include TORENEES (product of Toray Industries INC.), U-VARNISH (product of Ube Industries, Ltd.), RIKA COAT (product of New Japan Chemical Co., Ltd.), OPTOMER (product of JSR Corporation), SE812 (product of Nissan Chemical Industries, Ltd.) and CRC8000 (product of Sumitomo Bakelite Co., Ltd.).

—Method for Converting Polyimide Precursor to Polyimide—

The method for converting the polyimide precursor to a polyimide is not particularly limited and may be appropriately selected depending on the intended purpose. Examples thereof include a thermally treating method and a chemically treating method.

Of these, a thermally treating method is preferably employed since it is easily performed at low cost.

The thermally treating method is not particularly limited and may be appropriately selected depending on the intended purpose. In one exemplary method thereof, a filler is optionally mixed with or dispersed in a polyamic acid solution which has been synthesized or purchased to thereby prepare a coating liquid, and the resultant coating solution is applied to a support (a mold for molding) followed by heating at 200° C. to 350° C. for conversion to a polyimide.

The heating is not particularly limited and may be appropriately selected depending on the intended purpose. In order to obtain intrinsic properties of polyimide, the heating is preferably heating the coating liquid to a temperature equal to or higher than the glass transition temperature of a resultant polyimide so as to complete imidization.

The chemically treating method is not particularly limited and may be appropriately selected depending on the intended purpose. In one exemplary method thereof, a filler is optionally mixed with or dispersed in a polyamic acid solution which has been synthesized or purchased to thereby prepare a coating liquid, and the resultant coating solution is applied to a support (a mold for molding) followed by reaction with a dehydration ring forming reagent and then heating so as to complete imidization.

The dehydration ring forming reagent is not particularly limited and may be appropriately selected depending on the intended purpose. Examples thereof include a mixture of a carboxylic anhydride and a tertiary amine.

The heating is not particularly limited and may be appropriately selected depending on the intended purpose. In order to obtain intrinsic properties of polyimide, the heating is preferably heating the coating liquid to a temperature equal to or higher than the glass transition temperature of a resultant polyimide so as to complete imidization.

—Measurement Method for Imidization Ratio—

The measurement method for imidization ratio is not particularly limited and may be appropriately selected depending on the intended purpose. Examples thereof include a nuclear magnetic resonance (NMR) method in which the imidization ratio is determined on the basis of an integral ratio of $^{1}H$ of the amide group observed at about 9 ppm to about 11 ppm to $^{1}H$ of the aromatic ring observed at about 6 ppm to about 9 ppm, a Fourier transform infrared spectrophotometric method (i.e., a FT-IR method), a method of quantifying water formed as a result of ring formation of imides, and a method in which the amount of carboxylic acid is determined by a neutralization titration method.

Of these, a Fourier transform infrared spectrophotometric method (a FT-IR method) is preferred since it is a most commonly used method with which the imidization ratio is simply measured in a short time.

—Fourier Transform Infrared Spectrophotometric Method (FT-IR Method)—

The Fourier transform infrared spectrophotometric method (FT-IR method) is not particularly limited and may be appropriately selected depending on the intended purpose. Examples thereof include a method in which the imidization ratio defined as in the following Equation (a) is determined from the absorbances of the characteristic absorption of the imide group measured by the FT-IR method.

The Equation (a) is as follows:

$$\text{Imidization ratio (\%)}=[(A)/(B)]\times 100 \quad \text{(a)}$$

where (A) denotes an amount by mole of the imide group determined in the heating step (i.e., the imidization step) and (B) denotes an amount by mole of the imide group when the polyamic acid is completely (100%) imidized (theoretical value).

The type of the ratio of the absorbances of the characteristic absorption of the imide group is not particularly limited and may be appropriately selected depending on the intended purpose. Examples thereof include a ratio of the absorbance at 725 $cm^{-1}$ which is attributed to an imide (caused by the bending vibration of the C═O group of an imide ring) to the absorbance at 1,015 $cm^{-1}$ which is attributed to a benzene ring; a ratio of the absorbance at 1,380 $cm^{-1}$ which is attributed to an imide (caused by the bending vibration of the C—N group of an imide ring) to the absorbance at 1,500 $cm^{-1}$ which is attributed to a benzene ring; a ratio of the absorbance at 1,720 $cm^{-1}$ which is attributed to an imide (caused by the bending vibration of the C═O group of an imide ring) to the absorbance at 1,500 $cm^{-1}$ which is attributed to a benzene ring; and a ratio of the absorbance at 1,720 $cm^{-1}$ which is attributed to an imide (caused by the bending vibration of the C═O group of an imide ring) to the absorbance at 1,670 $cm^{-1}$ which is attributed to an amide group (the interaction of the bending vibration of a N—H group and the stretching vibration of a C—N group of an amide group). Alternatively, when it is confirmed that the multiple absorption bands attributed to an amide group at 3,000 $cm^{-1}$ to 3,300 $cm^{-1}$ have disappeared, the reliability of completion of the imidization is further enhanced.

—Polyamideimide Resin—

The polyamideimide resin (hereinafter may be referred to simply as "polyamideimide") is not particularly limited and may be appropriately selected depending on the intended purpose. Examples thereof include a resin containing, in the molecular skeleton thereof, both an imide group which is rigid and an amide group which imparts flexibility to the resin.

—Synthesis Method for Polyamideimide Resin—

The synthesis method for the polyamideimide resin is not particularly limited and may be appropriately selected depending on the intended purpose. Examples thereof include an acid chloride method and an isocyanate method.

—Acid Chloride Method—

The acid chloride method is not particularly limited and may be appropriately selected depending on the intended purpose. Examples thereof include a known method in which a halide compound derived from a trivalent carboxylic acid having an acid anhydride group and a diamine are dissolved in an organic polar solvent where they are allowed to react with each other at a low temperature of 0° C. to 30° C. to thereby produce a polyamideimide resin (described in, for example, Japanese Patent Application Publication (JP-B) No. 42-15637).

—Halide Compound Derived from Trivalent Carboxylic Acid Having an Acid Anhydride Group—

The halide compound derived from a trivalent carboxylic acid having an acid anhydride group is not particularly limited and may be appropriately selected depending on the intended purpose. Examples thereof include a compound represented by the following General Formulas (2) and (3). These may be used alone or in combination.

(2)

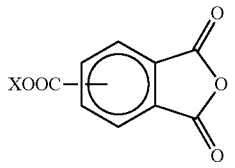

where X denotes a halogen atom.

(3)

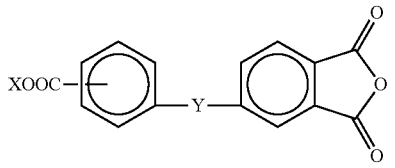

where X denotes a halogen atom and Y denotes a divalent group which is —$CH_2$—, —CO—, —$SO_2$— or —O—.

The halogen atom is not particularly limited and may be appropriately selected depending on the intended purpose. Examples thereof include a chlorine atom (i.e., the halide compound is a chloride) and a bromine atom (i.e., the halide compound is bromide). These may be used alone or in combination.

The chloride is not particularly limited and may be appropriately selected depending on the intended purpose. Examples thereof include acid chlorides of polycarboxylic acids.

The acid chloride of polycarboxylic acids is not particularly limited and may be appropriately selected depending on the intended purpose. Examples thereof include terephthalic acid chloride, isophthalic acid chloride, 4,4'-biphenyldicarboxylic acid chloride, 4,4'-biphenyletherdicarboxyulic acid chloride, 4,4'-biphenylsulfonedicarboxylic acid chloride, 4,4'-benzophenonedicarboxylic acid chloride, pyromellitic acid chloride, trimellitic acid chloride, 3,3',4,4'-benzophenonetetracarboxylic acid chloride, 3,3',4,4'-biphenylsulfonetetracarboxylic acid chloride, 3,3',4,4'-biphenyltetracarboxylic acid chloride, adipic acid chloride, sebacic acid chloride, maleic acid chloride, fumaric acid chloride, dimer acid chloride, stilbenedicarboxylic acid chloride, 1,4-cyclohexanedicarboxylic acid chloride and 1,2-cyclohexanedicarboxylic acid chloride. These may be used alone or in combination.

—Diamine—

The diamine is not particularly limited and may be appropriately selected depending on the intended purpose. Examples thereof include aromatic diamines, aliphatic diamines, alicyclic diamines, and siloxane compounds having amino groups at both ends thereof. These may be used alone or in combination.

Of these, aromatic diamines are preferred since it is excellent in mechanical strength, and siloxane compounds having amino groups at both ends thereof are preferred since a silicone-modified polyamideimide can be obtained.

The aromatic diamine is not particularly limited and may be appropriately selected depending on the intended purpose. Examples thereof include m-phenylenediamine, p-phenylenediamine, oxydianiline, methylenediamine, hexafluoroisopropylidene diamine, diamino-m-xylylene, diamino-p-xylylene, 1,4-napthalenediamine, 1,5-napthalenediamine, 2,6-napthalenediamine, 2,7-napthalenediamine, 2,2'-bis-(4-aminophenyl)propane, 2,2'-bis-(4-aminophenyl)hexafluoropropane, 4,4'-diaminodiphenyl sulfone, 4,4'-diaminodiphenyl ether, 3,3'-diaminodiphenyl sulfone, 3,3'-diaminodiphenyl ether, 3,4-diaminobiphenyl, 4,4'-diaminobenzophenone, 3,4-diaminodiphenyl ether, isopropylidenedianiline, 3,3'-diaminobenzophenone, o-tolidine, 2,4-tolylenediamine, 1,3-bis-(3-aminophenoxy)benzene, 1,4-bis-(4-aminophenoxy)benzene, 1,3-bis-(4-aminophenoxy)benzene, 2,2-bis-[4-(4-aminophenoxy)phenyl]propane, bis-[4-(4-aminophenoxy)phenyl]sulfone, bis-[4-(3-aminophenoxy)phenyl]sulfone, 4,4'-bis-(4-aminophenoxy)biphenyl, 2,2'-bis-[4-(4-aminophenoxy)phenyl]hexafluoropropane, 4,4'-diaminodiphenyl sulfide and 3,3'-diaminodiphenyl sulfide. These may be used alone or in combination.

Of these, 4,4'-diaminodiphenyl ether is preferred from the viewpoint of exhibiting high flexibility.

The siloxane compound having amino groups at both ends thereof is not particularly limited and may be appropriately selected depending on the intended purpose. Examples thereof include 1,3-bis(3-aminopropyl)-1,1,3,3-tetramethyldisiloxane, α,ω-bis(3-aminopropyl)polydimethylsiloxane, 1,3-bis(3-aminophenoxymethyl)-1,1,3,3-tetramethyldisiloxane, α,ω-bis(3-aminophenoxymethyl)polydimethylsiloxane, 1,3-bis(2-(3-aminophenoxy)ethyl)-1,1,3,3-tetramethyldisiloxane, α,ω-bis(2-(3-aminophenoxy)ethyl)polydimethylsiloxane, 1,3-bis(3-(3-aminophenoxy)propyl)-1,1,3,3-tetramethyldisiloxane and α,ω-bis(3-(3-aminophenoxy)propyl)polydimethylsiloxane. These may be used alone or in combination.

—Organic Polar Solvent—

The organic polar solvent is not particularly limited and may be appropriately selected depending on the intended purpose. It may be any of the same organic polar solvents as used in the above-described synthesis method for the polyimide resin.

—Polyamideimide Precursor—

The polyamideimide precursor (polyamide-amic acid) is not particularly limited and may be appropriately selected depending on the intended purpose. It may be, for example, an appropriately synthesized product or a commercially available product.

The synthesis method for the polyamideimide precursor is not particularly limited and may be appropriately selected depending on the intended purpose. Examples thereof include a method in which the halide compound derived from a trivalent carboxylic acid having an acid anhydride group and the diamine are dissolved in the organic polar solvent where they are allowed to react with each other at a low temperature of 0° C. to 30° C. to thereby produce a polyamideimide precursor (polyamide-amic acid).

—Conversion Method from Polyamideimide Precursor to Polyamideimide—

The method for converting the polyamideimide precursor to a polyamideimide is not particularly limited and may be appropriately selected depending on the intended purpose. Examples thereof include a method in which dehydration ring closing is performed through thermally treating and a method in which dehydration ring closing is performed through chemically treating.

The method in which dehydration ring closing is performed through thermally treating is not particularly limited and may be appropriately selected depending on the intended purpose. In one exemplary method thereof, a polyamide-amic acid solution is applied to a support (e.g., a mold for molding), followed by heating at a predetermined reaction temperature for a predetermined reaction time.

The reaction temperature in the thermally treating is not particularly limited and may be appropriately selected depending on the intended purpose. It is preferably 150° C. to 400° C., particularly preferably 180° C. to 350° C.

The reaction time in the thermally treating is not particularly limited and may be appropriately selected depending on the intended purpose. It is preferably 30 sec to 10 hours, particularly preferably 5 min to 5 hours.

The method in which dehydration ring closing is performed through chemically treating is not particularly limited and may be appropriately selected depending on the intended purpose. In one exemplary method thereof, a polyamide-amic acid solution is applied to a support (e.g., a mold for molding), followed by heating at a predetermined reaction temperature for a predetermined reaction time using a catalyst for dehydration ring closing.

The reaction temperature in the chemically treating is not particularly limited and may be appropriately selected depending on the intended purpose. It is preferably 0° C. to 180° C., particularly preferably 10° C. to 80° C.

The reaction time in the chemically treating is not particularly limited and may be appropriately selected depending on the intended purpose. It is preferably several tens minutes to several days, particularly preferably 2 hours to 12 hours.

The catalyst for dehydration ring closing is not particularly limited and may be appropriately selected depending on the intended purpose. Examples thereof include acids and anhydrides of benzoic acid, butylic acid and propionic acid.

—Isocyanate Method—

The isocyanate method is not particularly limited and may be appropriately selected depending on the intended purpose. Examples thereof include a known method in which a trivalent derivative having an acid anhydride group and a carboxylic acid is reacted in an organic polar solvent with an aromatic polyisocyanate to thereby produce a polyimideamide resin (see, for example, Japanese Patent Application Publication (JP-B) No. 44-19274).

—Trivalent Derivative Having an Acid Anhydride Group and a Carboxylic Acid—

The trivalent derivative having an acid anhydride group and a carboxylic acid is not particularly limited and may be appropriately selected depending on the intended purpose. Examples thereof include compounds represented by the following General Formulas (4) and (5) and trimellitic anhydride. These may be used alone or in combination.

Of these, trimellitic anhydride is most commonly used and is preferred from the viewpoint of being excellent in mechanical strength.

(4)

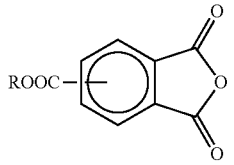

where R denotes a hydrogen atom, a C1-C10 alkyl group or a phenyl group.

(5)

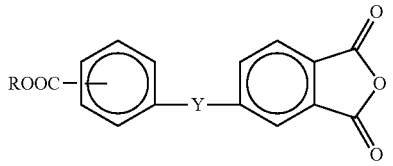

where R denotes a hydrogen atom, a C1-C10 alkyl group or a phenyl group and Y denotes a divalent group which is —$CH_2$—, —CO—, —$SO_2$—or —O—.

—Aromatic Polyisocyanate—

The aromatic polyisocyanate is not particularly limited and may be appropriately selected depending on the intended purpose. Examples thereof include 4,4'-diphenylmethane diisocyanate, tolylene diisocyanate, xylylene diisocyanate, 4,4'-diphenylether diisocyanate, 4,4'-[2,2-bis(4-phenoxyphenyl)propane]diisocyanate, biphenyl-4,4'-diisocyanate, biphenyl-3,3'-diisocyanate, biphenyl-3,4'-diisocyanate, 3,3'-dimethylbiphenyl-4,4'-diisocyanate, 2,2'-dimethylbiphenyl-4,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate and naphthalene-2,6-diisocyanate. These may be used alone or in combination.

The following may be used if necessary: aliphatic, alicyclic isocyanates such as hexamethylene diisocyanate, 2,2,4-trimethylhexamethylene diisocyanate, isophorone diisocyanate, 4,4'-dicyclohexylmethane diisocyanate, transcyclohexane-1,4-diisocyanate, hydrogenated m-xylene diisocyanate and lysine diisocyanate, and tri- or higher functional polyisocyanates. These may be used alone or in combination.

Of these, hexamethylene diisocyanate is preferred from the viewpoint of exhibiting excellent dissolvability.

—Organic Polar Solvent—

The organic polar solvent is not particularly limited and may be appropriately selected depending on the intended purpose. It may be any of the same organic polar solvents as used in the above-described synthesis method for the polyimide resin.

—Polyamideimide Precursor—

The polyamideimide precursor is not particularly limited and may be appropriately selected depending on the intended purpose. It may be, for example, an appropriately synthesized product or a commercially available product.

The synthesis method for the polyamideimide precursor is not particularly limited and may be appropriately selected depending on the intended purpose. Examples thereof include a method in which the trivalent derivative having an acid anhydride group and a carboxylic acid and the aromatic polyisocyanate are dissolved in an organic polar solvent where they are allowed to react with each other to produce a polyamideimide precursor.

The commercially available product of the polyamideimide precursor is not particularly limited and may be appropriately selected depending on the intended purpose. Examples thereof include polyamideimide varnish (product of TOYOBO CO., LTD., trade name "VYLOMAX HR-16NN").

—Method for Converting Polyamideimide Precursor to Polyamideimide—

The method for converting the polyamideimide precursor to a polyamideimide is not particularly limited and may be appropriately selected depending on the intended purpose. In one exemplary method thereof, a solution containing the polyamideimide precursor is applied to a support, followed by heating to convert the polyamideimide precursor to a polyamideimide.

With carbon dioxide being generated, the polyamideimide precursor is converted to the polyamideimide via no polyamic acid.

As one example of the conversion of the polyamideimide precursor to a polyamideimide, a case where trimellitic anhydride and an aromatic isocyanate are reacted together and then converted to a polyamideimide is shown in the following Reaction Scheme (6).

(6)

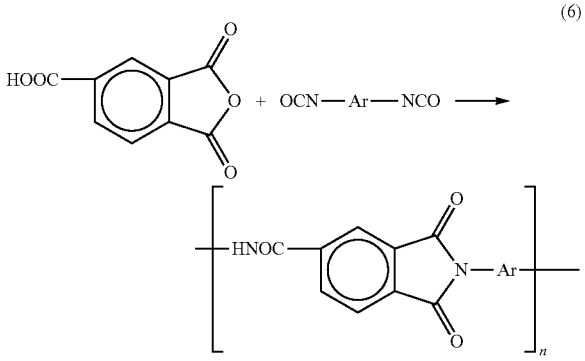

where Ar denotes an aromatic group.

<<Amount of Resin Contained in Base Layer>>

The amount of the resin contained in the base layer is not particularly limited and may be appropriately selected depending on the intended purpose. In general, the base layer contains a resin, an electrical resistance-controlling agent, a dispersing agent, a catalyst and a leveling agent. However, the total amount of the dispersing agent, catalyst and leveling agent is quite small. Thus, the rest of the base layer from which the amount of the electrical resistance-controlling agent has been subtracted can be used as the amount of the resin contained in the base layer.

<<Thickness of Base Layer>>

The thickness of the base layer is not particularly limited and may be appropriately selected depending on the intended purpose. It is preferably 30 μm to 150 μm, more preferably 40 μm to 120 μm, particularly preferably 50 μm to 80 μm. When the thickness of the base layer is smaller than 30 μm, the formed belt may break off due to cracks. When the thickness of the base layer exceeds 150 μm, the formed belt may split as a result of bending. When the thickness of the base layer is in the above particularly preferred range, the formed belt is excellent in durability, which is advantageous.

<<Method for Adjusting Thickness of Base Layer>>

The method for adjusting the thickness of the base layer is not particularly limited and may be appropriately selected depending on the intended purpose. Examples thereof include a method in which the thickness of the base layer is appropriately adjusted by measuring the thickness thereof with a contact-type film thickness meter and a method in which the thickness of the base layer is appropriately adjusted by observing the cross-sectional surface thereof under a scanning electron microscope (SEM).

<<Method for Forming Base Layer>>

The method for forming the base layer is not particularly limited and may be appropriately selected depending on the intended purpose. Examples thereof include a method in which the base layer is formed using a coating liquid containing at least a resin component in the present invention; i.e., a coating liquid containing the polyimide resin precursor or the polyamideimide resin precursor.

The method for forming the base layer will next be described in detail.

While a cylindrical metal mold is being slowly rotated, a coating liquid containing at least a resin component (e.g., a coating liquid containing the polyimide resin precursor or the polyamideimide resin precursor) is uniformly coated or flow-cast on the entire outer surface of the cylindrical metal mold with a liquid-supplying device such as a nozzle or a dispenser (to thereby form a coat film). Then, the rotation speed is increased to a predetermined value, at which the rotation speed is maintained constant for a desired period. Subsequently, the temperature is gradually increased while the cylindrical metal mold is being rotated, whereby the solvent is evaporated from the coat film at a temperature of about 80° C. to about 150° C. In this process, preferably, the vapor in the atmosphere (e.g., vaporized solvent) is removed through efficient circulation. When a self-supporting film is formed, the self-supporting film is placed together with the metal mold in a heating furnace (baking furnace) which can perform high-temperature treatment. The temperature of the furnace is gradually increased, and the metal mold is treated at a high temperature (baked) at the final temperature of about 250° C. to about 450° C., to thereby sufficiently imidizing or polyamideimidizing the polyimide resin precursor or the polyamideimide resin precursor. Thereafter, the resultant film is sufficiently cooled to form a base layer.

<<Other Ingredients>>

The other ingredients are not particularly limited and may be appropriately selected depending on the intended purpose. Suitable examples thereof include an electrical resistance-controlling agent. Further examples include a dispersing agent, a reinforcing agent, a lubricant, a thermal conducting agent, an antioxidant, a catalyst and a leveling agent, which may optionally be in trace amounts. These may be used alone or in combination.

—Electrical Resistance-Controlling Agent—

The electrical resistance-controlling agent is a filler (or an additive) for adjusting electrical resistance in the resin.

The electrical resistance-controlling agent is not particularly limited and may be appropriately selected depending on the intended purpose. Examples thereof include carbon black, a metal oxide, an ion conductive agent and a conductive polymer. These may be used alone or in combination.

Of these, carbon black is preferred from the viewpoint of making the resistance uniform.

—Carbon Black—

The carbon black is not particularly limited and may be appropriately selected depending on the intended purpose. Examples thereof include ketjen black, furnace black, acetylene black, thermal black and gas black.

—Metal Oxide—

The metal oxide is not particularly limited and may be appropriately selected depending on the intended purpose.

Examples thereof include zinc oxide, tin oxide, titanium oxide, zirconium oxide, aluminum oxide, silicon oxide, and products obtained by subjecting the above metal oxides to a surface treatment for improving dispersibility thereof.

—Ion Conductive Agent—

The ion conductive agent is not particularly limited and may be appropriately selected depending on the intended purpose. Examples thereof include tetraalkyl ammonium salts, trialkylbenzyl ammonium salts, alkylsulfonic acid salts, alkylbenzenesulfonic acid salts, alkylsulfates, glycerin fatty acid esters, sorbitan fatty acid esters, polyoxyethylenealkylamine, esters of polyoxyethylenealiphatic alcohols, alkylbetaine and lithium perchlorate.

—Conductive Polymer Material—

The conductive polymer material is not particularly limited and may be appropriately selected depending on the intended purpose. Examples thereof include polyparaphenylenes, polyanilines, polythiophenes and polyparaphenylenevinylene.

—Amount of Electrical Resistance-Controlling Agent—

The amount of the electrical resistance-controlling agent is not particularly limited and may be appropriately selected depending on the intended purpose. When producing the intermediate transfer member, in a coating liquid prepared by mixing in an appropriate proportion together the above resin components (e.g., the polyimide resin precursor or the polyamideimide resin precursor) and the electrical resistance-controlling agent, it is preferred that the amount of the electrical resistance-controlling agent used in the coating liquid fall within such a range that the formed film does not become brittle and is not easily cracked considering electrical characteristics (surface resistance and volume resistance) and mechanical strength.

When the amount of the electrical resistance-controlling agent is smaller than the lower limit of the above-described preferred range, it becomes difficult to make the resistance uniform, resulting in that the resistance at a certain electrical potential may be greatly varied. When the amount of the electrical resistance-controlling agent is larger than the upper limit of the above-described preferred range, the formed intermediate transfer belt decreases in mechanical strength and is not preferred for practical use. When the amount of the electrical resistance-controlling agent is in the above preferred range, the formed intermediate transfer belt is uniform in resistance and excellent in mechanical strength, which is advantageous.

The amount of the carbon black is not particularly limited and may be appropriately selected depending on the intended purpose. It is preferably 10% by mass to 25% by mass, more preferably 15% by mass to 20% by mass, relative to the total solid content of the coating liquid.

The amount of the metal oxide is not particularly limited and may be appropriately selected depending on the intended purpose. It is preferably 1% by mass to 50% by mass, more preferably 10% by mass to 30% by mass, relative to the total solid content of the coating liquid.

The amount of the ion conductive agent is not particularly limited and may be appropriately selected depending on the intended purpose. It is preferably 1% by mass to 10% by mass, more preferably 3% by mass to 7% by mass, relative to the total solid content of the coating liquid.

The amount of the conductive polymer material is not particularly limited and may be appropriately selected depending on the intended purpose. It is preferably 1% by mass to 10% by mass, more preferably 3% by mass to 7% by mass, relative to the total solid content of the coating liquid.

—Electrical Resistance—

The electrical resistance is preferably controlled to be $1\times10^{8}$ Ω/sq. to $1\times10^{14}$ Ω/sq. as surface resistance, and to be $1\times10^{7}$ Ω·cm to $1\times10^{13}$ Ω·cm as volume resistance.

<Elastic Layer>

The elastic layer contains at least a material having elasticity; and, if necessary, further contains other ingredients.

<<Material Having Elasticity>>

The material having elasticity is not particularly limited and may be appropriately selected depending on the intended purpose. Examples thereof include elastomers and rubbers.

Of these, preferably used are rubber materials such as elastomers and rubbers each having a Martens hardness of 1.0 or lower and an elastic recovery rate of 75% or higher, since these have a sufficient flexibility (elasticity) to exhibit the effects of the present invention.

—Elastomer—

The elastomer is not particularly limited and may be appropriately selected depending on the intended purpose. Examples thereof include thermoplastic elastomers and thermosetting elastomers. These may be used alone or in combination.

The thermoplastic elastomer is not particularly limited and may be appropriately selected depending on the intended purpose. Examples thereof include polyester elastomers, polyamide elastomers, polyether elastomers, polyurethane elastomers, polyolefin elastomers, polystyrene elastomers, polyacryl elastomers, polydiene elastomers, silicone-modified polycarbonate elastomers and fluorine copolymer elastomers.

The thermosetting elastomer is not particularly limited and may be appropriately selected depending on the intended purpose. Examples thereof include polyurethane elastomers, silicone-modified epoxy elastomers and silicone-modified acryl elastomers.

Of these, the thermosetting elastomer is preferably used, since it can reliably fix particles with no use of an adhesion layer, etc. when forming a particle layer on the surface of the elastic layer. This is because the thermosetting elastomer has functional groups contributing to curing reaction which exhibit excellent tackiness or adhesiveness to fine particles.

—Rubber—

The rubber is not particularly limited and may be appropriately selected depending on the intended purpose. Examples thereof include isoprene rubbers, styrene rubbers, butadiene rubbers, nitrile rubbers, ethylenepropylene rubbers, butyl rubbers, silicone rubber, chloroprene rubbers, acryl rubbers, chlorosulfonated polyethylenes, fluorine rubbers, urethane rubbers, hydrin rubbers, acrylonitrile butadiene rubbers and vulcanized rubbers. These may be used alone or in combination.

Of these, acrylonitrile butadiene rubbers and vulcanized rubbers are preferably used, since they can reliably fix particles with no use of an adhesion layer, etc. when forming a particle layer on the surface of the elastic layer. This is because they have functional groups contributing to curing reaction which exhibit excellent tackiness or adhesiveness to fine particles.

<<Thickness of Elastic Layer>>

The thickness of the elastic layer is not particularly limited and may be appropriately selected depending on the intended purpose. It is preferably 200 μm to 2,000 μm, more preferably 300 μm to 1,000 μm, particularly preferably 400 μm to 700 μm. When the thickness of the elastic layer is smaller than 200 μm, the followability to surface irregularities of a transfer medium and the transfer pressure-reducing effect are lowered. When the thickness of the elastic layer exceeds 2,000 μm, the mass of the film becomes large. As a result, the film may easily be warped and unstable in running. Cracks tend to occur at part of the belt which is curved so as to be wound around the rollers in a stretched manner. When the thickness of the elastic layer is in the particularly preferred range, the formed belt is excellent in driving performance and followability to paper, which is advantageous.

<<Method for Adjusting Thickness of Elastic Layer>>

The method for adjusting the thickness of the elastic layer is not particularly limited and may be appropriately selected depending on the intended purpose. Examples thereof include a method in which the thickness of the elastic layer is appropriately adjusted by observing the cross-sectional surface thereof under a scanning electron microscope (SEM).

<<Method for Forming Elastic Layer>>

The method for forming the elastic layer is not particularly limited and may be appropriately selected depending on the intended purpose. Examples thereof include a method in which the elastic layer is formed on the base layer through, for example, injection molding or extrusion molding and a method in which a liquid thermosetting elastomer material is applied onto the base layer to form the elastic layer.

The method for forming the elastic layer will next be described in detail.

In the same manner as the formation of the base layer, while a cylindrical metal mold is being slowly rotated, a coating liquid containing at least a liquid thermosetting elastomer material is uniformly coated or flow-cast on the entire outer surface of the cylindrical metal mold with a liquid-supplying device such as a nozzle or a dispenser (to thereby form a coat film). Then, the rotation speed is increased to a predetermined value, at which the rotation speed is maintained constant for a desired period. Thereafter, the resultant film is sufficiently leveled to form an elastic layer.

<<Other Ingredients>>

The elastic layer may optionally contain other ingredients in trace amounts.

The other ingredients are not particularly limited and may be appropriately selected depending on the intended purpose. Examples thereof include an electrical resistance-controlling agent, flame retardants for imparting flame retardancy, antioxidants, reinforcing agents, fillers and vulcanization promoters. These may be used alone or in combination.

—Electrical Resistance-Controlling Agent—

The electrical resistance-controlling agent is not particularly limited and may be appropriately selected depending on the intended purpose. Since carbon black, metal oxides, etc. impair flexibility of the resultant product, the amounts of them are preferably lowered. Preferably, an ion conductive agent, a conductive polymer or the like is used.

—Electrical Resistance—

The resistance of the elastic layer is not particularly limited and may be appropriately selected depending on the intended purpose. For example, the resistance of the elastic layer is preferably adjusted so that the surface resistance thereof is $1\times10^{8}$ Ω/sq. to $1\times10^{13}$ Ω/sq. and the volume resistance thereof is $1\times10^{7}$ Ω·cm to $1\times10^{13}$ Ω·cm.

<Particle Layer>

The particle layer contains at least fine spherical particles; and, if necessary, further contains other ingredients.

<<Fine Spherical Particles>>

The fine spherical particles refer to fine particles which have an average particle diameter of 100 μm or less, which have a truly spherical shape, which do not dissolve in an organic solvent, and in which the temperature at which 3% thereof thermally decompose is 200° C. or higher.

The fine spherical particles are not particularly limited and may be appropriately selected depending on the intended purpose. Examples thereof include fine spherical particles mainly containing a rubber or a resin (e.g., an acryl resin, melamine resin, polyamide resin, polyester resin, silicone resin and fluorine resin); hollow or porous fine spherical particles obtained by subjecting these fine spherical particles to a surface treatment with different materials; fine spherical particles obtained by applying a hard resin onto the surfaces of the particles made of a rubber material; and fine spherical particles produced through a polymerization method using silicone particles and fluorine particles.

Of these, preferred are fine spherical particles produced through a polymerization method using silicone particles and fluorine particles, since they have lubricity and thus can impart, to the resultant intermediate transfer member, high releaseability to toner particles and high abrasion resistance. The fine spherical particles are preferably spherical to the greatest extent possible.

The fine spherical particles are not particularly limited and may be an appropriately synthesized product or a commercially available product. Examples of the commercially available product include silicone particles (product of Momentive Performance Materials Inc., trade names "TOSPEARL 120," "TOSPEARL 145" "TOSPEARL 2000B") and acryl particles (product of SEKISUI PLASTICS CO., LTD., trade name "Techno Polymer MBX-SS").

—Form of Fine Spherical Particles—

The form of the fine spherical particles is not particularly limited and may be appropriately selected depending on the intended purpose. Examples thereof include a form in which the fine spherical particles are arranged on the elastic layer to form a single layer in the thickness direction and a form in which two or more of the fine spherical particles are stacked on top of each other in the thickness direction.

Of these, preferred is a form in which the fine spherical particles are arranged on the elastic layer to form a single layer in the thickness direction. This is because such a form can easily be attained through a process including: directly applying particles on the elastic layer and leveling the particles to uniformly arrange the particles. In addition, the fine spherical particles in this form can stably form high-quality images.

Meanwhile, in the form in which two or more of the fine spherical particles are stacked on top of each other in the thickness direction, the distribution of the fine spherical particles becomes uneven. As a result, due to the electrical resistance of the fine spherical particles, electrical characteristics on the belt surface also become ununiform to cause image failures. Specifically, the electrical resistance becomes high in a region where a large amount of the particles exist, and surface potential is generated in this region due to residual charges. This makes the surface potential ununiform on the belt surface to cause the difference in image density between this region and the neighboring regions, resulting in that image failures may be visualized.

—Volume Average Particle Diameter of Fine Spherical Particles—

The volume average particle diameter of the fine spherical particles is not particularly limited and may be appropriately selected depending on the intended purpose. It is preferably 0.3 μm to 10 μm, more preferably 0.5 μm to 5 μm, particularly preferably 1 μm to 3 μm. Also, it is preferably monodispersed; i.e., a sharp distribution. When the volume average particle diameter thereof is less than 0.3 μm, the fine spherical particles do not sufficiently exhibit the effect of improving transfer performance. When the volume average particle diameter thereof is 10 μm or greater, the surface roughness becomes large, and the interparticle spaces becomes large also. As a result, the toner cannot be transferred satisfactorily, and cleaning failures arise. In addition, the charge potential remains on the particles, potentially causing image failures during continuous output of images. When the volume average particle diameter of the fine spherical particles is in the above particularly preferred range, no image failures occur, which is advantageous.

<<Method for Forming Particle Layer>>

Figure 3:
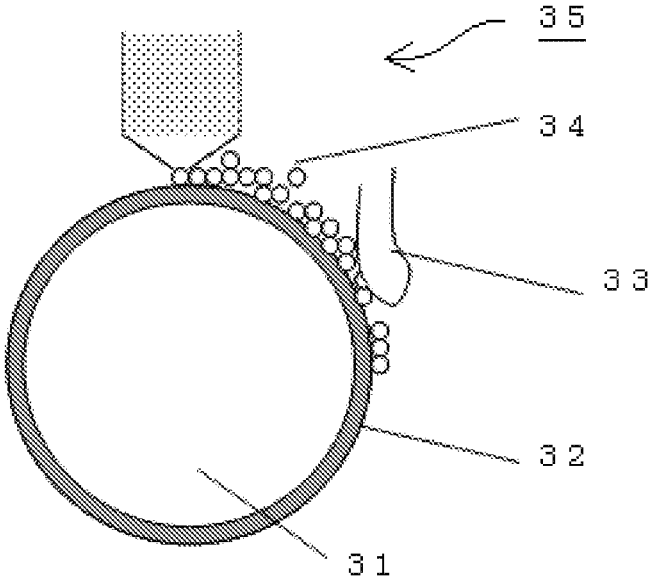
FIG. 3 shows an exemplary manner in which fine spherical particles are uniformly embedded in a surface of an elastic layer.

The method for forming the particle layer is not particularly limited and may be appropriately selected depending on the intended purpose. In one exemplary method thereof, as shown in FIG. 3, after a powder-supplying device 35 and a press member 33 have been set, fine spherical particles 34 are uniformly applied onto the underlying layer surface from the powder-supplying device 35 while the cylindrical metal mold is being rotated. Then, the press member 33 is pressed against the thus-applied fine spherical particles on the underlying layer surface at a constant pressure. Pressing by the press member 33 embeds the fine spherical particles in the underlying layer while removing the extra particles. The resultant uniform particle layer is heated and cured at a predetermined temperature for a predetermined time while the cylindrical metal mold is being rotated, whereby a particle layer is formed.

Since the spherical particles used for forming the particle layer are monodispersed fine spherical particles, a uniform particle monolayer can be formed through only such a leveling step using the press member.

<<Other Ingredients>>

The other ingredients are not particularly limited and may be appropriately selected depending on the intended purpose, so long as they do not impair the effects of the present invention.

<Method for Producing Intermediate Transfer Member>

The method for producing the intermediate transfer member is not particularly limited and may be appropriately selected depending on the intended purpose. In one exemplary method, first, a relatively flexible but rigid base layer is formed on a cylindrical metal mold. Second, a flexible elastic layer is formed on the base layer. Third, a particle layer is formed on the elastic layer such that fine spherical particles are partially embedded in the elastic layer. After thorough cooling, the resultant laminated product is separated from the metal mold together with the base layer, to thereby produce an intermediate transfer member of interest.

<Martens Hardness of Intermediate Transfer Member>

The Martens hardness of the intermediate transfer member is not particularly limited and may be appropriately selected depending on the intended purpose. It must be 1.0 $N/mm^2$ or lower, preferably 0.8 $N/mm^2$ or lower, more preferably 0.6 $N/mm^2$ or lower. When the Martens hardness of the intermediate transfer member exceeds 1.0 $N/mm^2$, the intermediate transfer member becomes poor in followability to paper having irregularities. In addition, since the adhesion force between the particles and the elastic layer is low, the particles tend to be exfoliated to potentially cause various failures such as transfer failure and cleaning failure. When the Martens hardness of the intermediate transfer member is in the more preferred range, the particles can reliably be fixed with no use of an adhesion layer, etc. by virtue of functional groups contributing to curing reaction which exhibit excellent tackiness or adhesiveness to the fine particles. As a result, the intermediate transfer member can stably form high-quality images, which is advantageous.

<<Method for Measuring Martens Hardness of Intermediate Transfer Member>>

The method for measuring the Martens hardness of the intermediate transfer member is not particularly limited and may be appropriately selected depending on the intended purpose. In one employable method, the Martens hardness of the intermediate transfer member is measured with a commercially available microhardness tester (Fischer Instruments, Co., trade name "FischerScopeHM2000LT") with the maximum load being set to 40 mN.

<Elastic Recovery Rate (ηIT) of Intermediate Transfer Member>

ηIT is elastic part of indentation work in %. Quotient of elastic deformation work and total deformation work. The elastic recovery rate of the intermediate transfer member is not particularly limited and may be appropriately selected depending on the intended purpose. It must be 75% or higher, preferably 80% or higher, more preferably 85% or higher. When the elastic recovery rate of the intermediate transfer member is lower than 75%, it takes an unfavorably long time for the intermediate transfer member to recover to the original shape from the deformed shape after it follows the irregularities of paper. Thus, when continuously feeding paper sheets each having irregularities, the traces of the irregularities are left in the belt to potentially cause image failures such as transfer unevenness. When the elastic recovery rate of the intermediate transfer member is in the above more preferred range, the particles can reliably be fixed with no use of an adhesion layer, etc. by virtue of functional groups contributing to curing reaction which exhibit excellent tackiness or adhesiveness to the fine particles. As a result, the intermediate transfer member can stably form high-quality images, which is advantageous.

<<Method for Measuring Elastic Recovery Rate of Intermediate Transfer Member>>

The method for measuring the elastic recovery rate of the intermediate transfer member is not particularly limited and may be appropriately selected depending on the intended purpose. For example, it may be the same as the method for measuring the Martens hardness of the intermediate transfer member.

<Embedment Rate of Fine Spherical Particles in Intermediate Transfer Member>

The embedment rate of the fine spherical particles in the intermediate transfer member is not particularly limited and may be appropriately selected depending on the intended purpose. It must be 33% to 99%, preferably 40% to 90%, more preferably 50% to 75%. When the embedment rate of the fine spherical particles in the intermediate transfer member is lower than 33%, the particles tend to exfoliate after long-term use in an image forming apparatus, potentially leading to degradation in durability and unevenness in image density. When the embedment rate thereof exceeds 99%, the particles cannot satisfactorily exhibit the effect of improving transfer performance in some cases. When the embedment rate of the fine spherical particles in the intermediate transfer member is in the above more preferred range, excellent durability can be obtained, which is advantageous.

<<Method for Measuring Embedment Rate of Fine Spherical Particles in Intermediate Transfer Member>>

The method for measuring the embedment rate of the fine spherical particles in the intermediate transfer member is not particularly limited and may be appropriately selected depending on the intended purpose. In one employable method for measuring the embedment rate thereof, the cross-sectional surface of the intermediate transfer member is observed under a scanning electron microscope (SEM); ten arbitrary fine spherical particles in the intermediate transfer member are selected; each of the selected ten fine spherical particles is measured for the total volume thereof and the volume of part thereof embedded in the elastic layer (the volume of the embedded part); the measured volumes are used to calculate the ratio of the volume of the embedded part to the total volume (i.e., the volume of the embedded part/the total volume); and the ratios of the ten fine spherical particles are averaged to obtain an average embedment rate. The embedment rate is adjusted by adjusting the pressing time of the press member.

(Image Forming Apparatus)

An image forming apparatus of the present invention includes an image bearing member configured to form a latent image thereon and bear a toner image, a developing unit configured to develop with a toner the latent image formed on the image bearing member, an intermediate transfer member onto which the toner image developed with the developing unit is primarily transferred, and a transfer unit configured to secondarily transfer onto a recording medium the toner image formed on the intermediate transfer member; and, if necessary, further includes appropriately selected other units such as a charge-eliminating unit, a cleaning unit, a recycling unit and a controlling unit.

Preferably, the image forming apparatus is a full-color image forming apparatus where a plurality of image bearing members each having a developing unit for each color are arranged in series.

Referring to a schematic view of essential parts, next will be described in detail a seamless belt used in a belt constitution section included in the image forming apparatus of the present invention. Notably, this schematic view is one example and thus, should not be construed as limiting the present invention thereto.

FIG. 1 shows a layer structure of an intermediate transfer member suitably used in the present invention.

Figure 2:
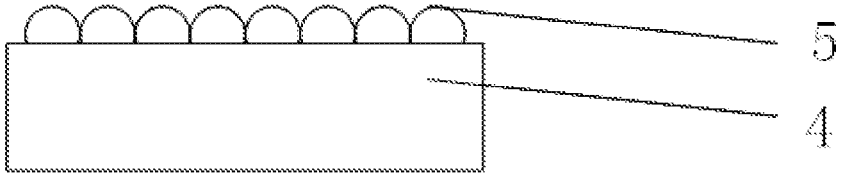
FIG. 2 is an explanatory view of one surface structure of an intermediate transfer member of the present invention.

In this layer structure, a flexible elastic layer 2 is formed on a relatively flexible but rigid base layer 1, and a particle layer is formed on the elastic layer as the uppermost layer so as to contain particles 3 partially embedded in the elastic layer. FIG. 2 is an enlarged view of the surface of the intermediate transfer member shown in FIG. 1. In FIG. 2, the particles 5 are arranged in the elastic layer 4.

Figure 4:
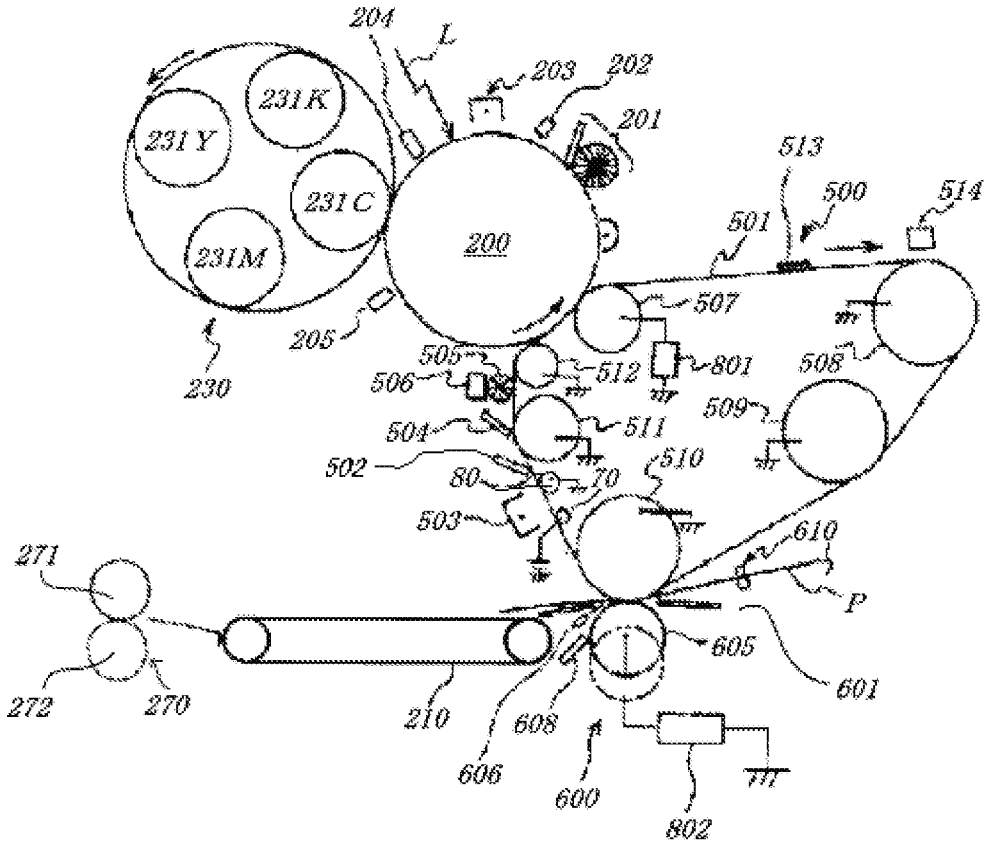
FIG. 4 schematically illustrates essential parts for explaining one exemplary image forming apparatus.

FIG. 4 is a schematic view of essential parts for describing an image forming apparatus including as a belt member a seamless belt used in the present invention. An intermediate transfer unit 500 having a belt member as shown in FIG. 4 includes, for example, an intermediate transfer belt 501 serving as an intermediate transfer member stretched around a plurality of rollers. A secondary transfer bias roller 605 serving as a secondary transfer charge applying unit of a secondary transfer unit 600, a belt cleaning blade 504 serving as a cleaning unit for the intermediate transfer member, a lubricant applying brush 505 serving as a lubricant applying member of a lubricant applying unit, etc. are provided around the intermediate transfer belt 501 so as to face the intermediate transfer belt 501.

A position detecting mark is formed on an outer or inner surface of the intermediate transfer belt 501. When the position detecting mark is formed on the outer surface of the intermediate transfer belt 501, it is necessary that the mark is located at a position so as not to come into contact with the cleaning blade 504. When this configuration is hard to achieve, the mark may be formed on an inner surface of the intermediate transfer belt 501. An optical sensor 514 serving as a sensor for detecting marks is disposed at a position between a primary transfer bias roller 507 and a belt driving roller 508 around which the intermediate transfer belt 501 is wound.

The intermediate transfer belt 501 is stretched around the primary transfer bias roller 507 serving as a primary transfer charge applying unit, the belt driving roller 508, a belt tension roller 509, a secondary transfer opposing roller 510, a cleaning opposing roller 511, and a feedback current detecting roller 512. Each roller is formed of a conductive material, and respective rollers other than the primary transfer bias roller 507 are grounded. A transfer bias is applied to the primary transfer bias roller 507, the transfer bias being controlled at a predetermined level of current or voltage according to the number of superposed toner images by means of a primary transfer power source 801 controlled at a constant current or a constant voltage.

The intermediate transfer belt 501 is driven in the direction indicated by the arrow with the belt driving roller 508 which is driven with a driving motor so as to rotate in the direction indicated by the arrow. The intermediate transfer belt 501 serving as the belt member is generally semiconductive or insulative, and has a single layer or a multi layer structure. In the present invention, a seamless belt is preferably used, so as to improve durability and attain excellent image formation. Moreover, the intermediate transfer belt is larger than the maximum size capable of passing paper so as to superpose toner images formed on a photoconductor drum 200.

The secondary transfer bias roller 605 is a secondary transfer unit configured to be brought into contact with a portion of the outer surface of the intermediate transfer belt 501, the portion being stretched around the secondary transfer opposing roller 510 by means of an attaching/detaching mechanism serving as an attaching/detaching unit described below. The secondary transfer bias roller 605 which is disposed so as to hold a transfer paper P (recording medium) with a portion of the intermediate transfer belt 501 which is stretched around the secondary transfer opposing roller 510, is applied with a transfer bias of a predetermined current by the secondary transfer power source 802 controlled at a constant current.

A pair of registration rollers 610 feed the transfer paper P (transfer medium) at a predetermined timing between the secondary transfer bias roller 605 and the intermediate transfer belt 501 stretched around the secondary transfer opposing roller 510. A cleaning blade 608 serving as a cleaning unit is in contact with the secondary transfer bias roller 605. The cleaning blade 608 performs cleaning by removing matter deposited on the surface of the secondary transfer bias roller 605.

In a color copier having this configuration, when an image formation cycle starts, the photoconductor drum 200 is rotated by a driving motor in the counterclockwise direction indicated by the arrow, so as to form Bk (black), C (cyan), M (magenta) and Y (yellow) toner images on the photoconductor drum 200. The intermediate transfer belt 501 is driven in the clockwise direction indicated by the arrow with the belt driving roller 508. Along with the rotation of the intermediate transfer belt 501, the formed Bk-toner image, C-toner image, M-toner image and Y-toner image are primarily transferred by means of a transfer bias based on a voltage applied to the primary transfer bias roller 507. Finally, the images are superposed on top of each other in the order of Bk, C, M and Y on the intermediate transfer belt 501, to thereby form a composite image.

For example, the Bk toner image is formed as follows. In FIG. 4, a charger 203 uniformly negatively charges a surface of the photoconductor drum 200 to a predetermined potential through corona discharging. Subsequently, at a timing determined based on the belt mark detection signals, raster exposure is performed based on a Bk color image signal by use of an optical writing unit. When the raster image is exposed, a charge proportional to the amount of light exposure disappears and a Bk latent electrostatic image is thereby formed in an exposed portion of the photoconductor drum 200 which has been uniformly charged. Then, by bringing a negatively charged Bk toner on the developing roller of a Bk developing device 231K into contact with the Bk latent electrostatic image, the Bk toner does not adhere to a portion on the photoconductor drum 200 where a charge remains, and the Bk toner adsorbs to a portion on the photoconductor drum 200 where there is no charge, in other words a portion undergone the raster light exposure, to thereby form a Bk toner image corresponding to the latent electrostatic image.

The Bk toner image formed on the photoconductor drum 200 is primarily transferred to the outer surface of the intermediate transfer belt 501 being in contact with the photoconductor drum 200, in which the intermediate transfer belt 501 and the photoconductor drum 200 are driven at an equal speed. After primary transfer, a slight amount of the residual toner which has not been transferred from the photoconductor drum 200 to the intermediate transfer belt 501 is cleaned with a photoconductor cleaning device 201 for the next image formation on the photoconductor drum 200. Next to the Bk image forming process, the operation of the photoconductor drum 200 then proceeds to a C image forming process, in which C image data is read with a color scanner at a predetermined timing, and a C latent electrostatic image is formed on the photoconductor drum 200 through laser light writing based on the C image data.

A revolver development unit 230 is rotated after the rear edge of the Bk latent electrostatic image has passed and before the front edge of the C latent electrostatic image reaches, and the C developing unit 231C is set to a developing position, where the C latent electrostatic image is developed with C toner. From then on, development is continued over the area of the C latent electrostatic image, and at the point of time when the rear edge of the C latent electrostatic image has passed, the revolver development unit rotates in the same manner as the previous case of the Bk developing unit 231K to allow the M developing unit 231M to move to the developing position. This operation is also completed before the front edge of a Y latent electrostatic image reaches the developing position. As for M and Y image forming steps, the operations of scanning respective color image data, the formation of latent electrostatic images, and their development are the same as those of Bk and C, therefore, explanation of the steps is omitted.

Bk, C, M, and Y toner images sequentially formed on the photoconductor drum 200 are sequentially registered in the same plane and primarily transferred onto the intermediate transfer belt 501. Accordingly, the toner image whose four colors at the maximum are superposed on top of each other is formed on the intermediate transfer belt 501. The transfer paper P is fed from the paper feed section such as a transfer paper cassette or a manual feeder tray at the time when the image forming operation starts, and waits at the nip of the registration rollers 610. The registration rollers 610 are driven so that the front edge of the transfer paper P along a transfer paper guide plate 601 just meets the front edge of the toner image when the front edge of the toner image on the intermediate transfer belt 501 is about to reach a secondary transfer section where the nip is formed by the secondary transfer bias roller 605 and the intermediate transfer belt 501 stretched around the secondary transfer opposing roller 510, and registration is performed between the transfer paper P and the toner image.

When the transfer paper P passes through the secondary transfer section, the four-color superposed toner image on the intermediate transfer belt 501 is collectively transferred (secondary transfer) onto the transfer paper P by transfer bias based on the voltage applied to the secondary transfer bias roller 605 by the secondary transfer power source 802. When the transfer paper P passes through a portion facing a transfer paper discharger 606 formed of charge eliminating spines and disposed downstream of the secondary transfer section in a moving direction of a transfer paper guiding plate 601, a charge on the transfer paper sheet is removed and then the transfer paper P is separated from the transfer paper guiding plate 601 to be delivered to a fixing unit 270 via the belt transfer unit 210 which is included in the belt constitution section (see FIG. 4). Furthermore, a toner image is then fused and fixed on the transfer paper P at a nip portion between fixing rollers 271 and 272 of the fixing unit 270, and the transfer paper P is then discharged outside of a main body of the apparatus by a discharging roller and is stacked in a copy tray with a front side up. If necessary, the fixing unit 270 may have a belt constitution section.

On the other hand, the surface of the photoconductor drum 200 after the toner images have been transferred to the belt is cleaned by the photoconductor cleaning unit 201, and is uniformly charge-eliminated by a charge-eliminating lamp 202. After the toner image has been secondarily transferred to the transfer paper P, the toner remaining on the outer surface of the intermediate transfer belt 501 is cleaned by the belt cleaning blade 504. The belt cleaning blade 504 is configured to be brought into contact with the outer surface of the intermediate transfer belt 501 at a predetermined timing by the cleaning member attaching/detaching mechanism.

Upstream of the belt cleaning blade 504 with respect to the rotating direction of the intermediate transfer belt 501, a toner sealing member 502 is provided so as to be brought into contact with the outer surface of the intermediate transfer belt 501. The toner sealing member 502 is configured to receive the toner particles scraped off with the belt cleaning blade 504 during cleaning of the residual toner, so as to prevent the toner particles from being scattered on a conveyance path of the transfer paper P. The toner sealing member 502, together with the belt cleaning blade 504, is brought into contact with the outer surface of the intermediate transfer belt 501 by the cleaning member attaching/detaching mechanism.

To the outer surface of the intermediate transfer belt 501 from which the residual toner has been removed, a lubricant 506 is applied with being scraped off with a lubricant applying brush 505. The lubricant 506 is formed of zinc stearate, etc. in a solid form, and disposed to be brought into contact with the lubricant applying brush 505. The charge remaining on the outer surface of the intermediate transfer belt 501 is removed by charge-eliminating bias applied with a belt charge-eliminating brush, which is in contact with the outer surface of the intermediate transfer belt 501. The lubricant applying brush 505 and the belt charge-eliminating brush are respectively configured to be brought into contact with the outer surface of the intermediate transfer belt 501 at a predetermined timing by means of an attaching/detaching mechanism.

When the copying operation is repeated, in order to perform an operation of the color scanner and image formation on the photoconductor drum 200, the operation proceeds to an image forming process of the first color (Bk) of the second sheet at a predetermined timing subsequent to an image forming process of the fourth color (Y) of the first sheet. As for the intermediate transfer belt 501, a Bk toner image of the second sheet is primarily transferred to the outer surface of the intermediate transfer belt 501 in an area which has been cleaned by the belt cleaning blade 504 subsequent to a transfer process of the toner image of four colors on the first sheet of the transfer paper. Then, the same operations are performed for the next sheet as for the first sheet. Operations have been described in a copy mode in which full-color copies of four colors are obtained. The same operations are performed the number of corresponding times for specified colors in copy modes of three or two colors. In a monochrome-color copy mode, only the developing unit of a predetermined color in the revolver development unit 230 is put in a development active state until the copying operation is completed for the predetermined number of sheets, and the belt cleaning blade 504 is kept in contact with the intermediate transfer belt 501 while the copying operation is continuously performed.

Figure 5:
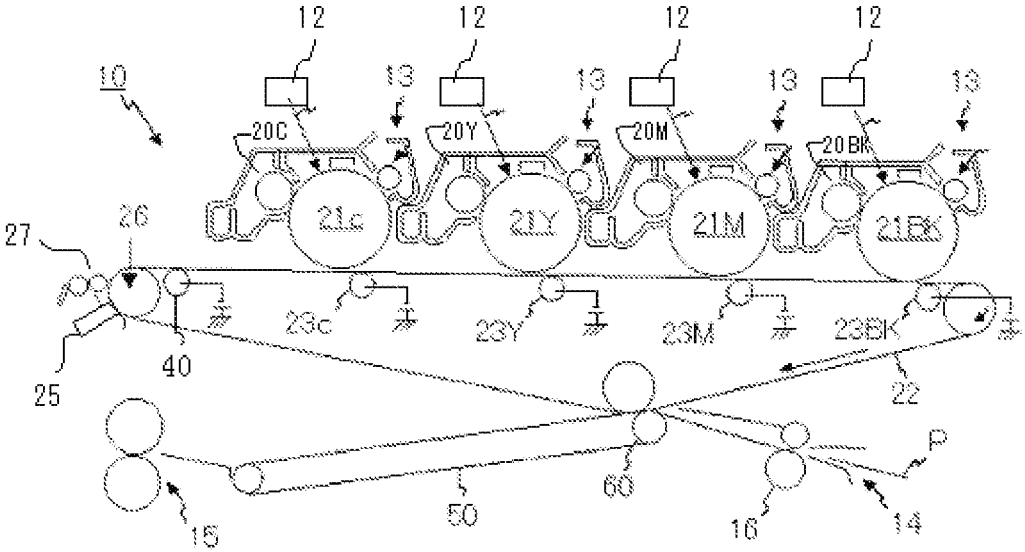
FIG. 5 schematically illustrates essential parts for explaining another exemplary image forming apparatus.

In the above-described embodiment, a copier having only one photoconductor drum 200 is described. However, the intermediate transfer belt of the present invention can be used, for example, in a tandem type image forming apparatus whose example is shown in FIG. 5 (schematic view of essential parts), in which a plurality of photoconductor drums are serially arranged along an intermediate transfer belt formed in the seamless belt. FIG. 5 shows one example of the configuration of a four-drum digital color printer having four photoconductor drums 21Bk, 21Y, 21M and 21C for forming toner images of four different colors (black, yellow, magenta and cyan).

In FIG. 5, a main body of a printer 10 is composed of image writing sections 12, image forming sections 13 and paper feeding sections 14, for electrophotographic color image formation. Based on image signals, image processing operation is performed in an image processing section, and converted to color signals of black (Bk), magenta (M), yellow (Y) and cyan (C), and then the color signals are transmitted to the image writing sections 12. The image writing sections 12 are laser scanning optical systems each including a laser light source, a deflector such as a rotary polygon mirror, a scanning imaging optical system, and a group of mirrors, and have four optical writing paths corresponding to color signals, and perform image writing corresponding to respective color signals on image bearing members (photoconductors) 21Bk, 21M, 21Y and 21C provided for respective colors in the image forming sections 13.

The image forming sections 13 includes four photoconductors 21Bk, 21M, 21Y and 21C serving as image bearing members for black (Bk), magenta (M), yellow (Y) and cyan (C). Generally, organic photoconductors (OPCs) are used as these photoconductors. Around each of the photoconductors 21Bk, 21M, 21Y and 21C are arranged a charging unit, an exposure portion irradiated with laser beam from the image writing section 12, a developing unit 20Bk, 20M, 20Y or 20C, a primary transfer bias roller 23Bk, 23M, 23Y or 23C serving as a primary transfer unit, a cleaning unit, and other devices such as a charge-eliminating unit for the photoconductor. Each of the developing units 20Bk, 20M, 20Y and 20C employs a two component magnet brush developing method. An intermediate transfer belt 22, which is the belt constitution section, is located between the photoconductor 21Bk, 21M, 21Y or 21C and the primary transfer bias roller 23Bk, 23M, 23Y or 23C. The color toner images formed on the photoconductors are sequentially superposingly transferred onto the intermediate transfer belt 22.

The transfer paper P fed from the paper feeding section 14 is fed via a registration roller 16 and then held by a transfer conveyance belt 50 as a belt constitution section. The toner images transferred onto the intermediate transfer belt 22 are secondarily transferred (collectively transferred) to the transfer paper P by a secondary transfer bias roller 60 serving as a secondary transfer unit at a point in which the intermediate transfer belt 22 is brought into contact with the transfer conveyance belt 50. Thus, a color image is formed on the transfer paper P. The transfer paper P on which the color image is formed is fed to a fixing unit 15 via the transfer conveyance belt 50, and the color image is fixed on the transfer paper P by the fixing unit 15, and then the transfer paper P is discharged from the main body of the printer.

Toner particles remaining on the surface of the intermediate transfer belt 22, which has not been transferred in the secondary transfer process, are removed by a belt cleaning member 25 from the intermediate transfer belt 22. Downstream of the belt cleaning member 25 with respect to the rotation direction of the intermediate transfer belt 22, a lubricant applying unit 27 is provided. The lubricant applying unit 27 includes a solid lubricant and a conductive brush configured to rub the intermediate transfer belt 22 so as to apply the solid lubricant to the surface of the intermediate transfer belt 22. The conductive brush is constantly in contact with the intermediate transfer belt 22, so as to apply the solid lubricant to the intermediate transfer belt 22. The solid lubricant is effective to improve the cleanability of the intermediate transfer belt 22, thereby preventing occurrence of filming thereon, and improving durability of the intermediate transfer belt 22.

EXAMPLES

The present invention will next be described by way of Examples and Comparative Examples. The present invention, however, should not be construed as being limited to the Examples.

Example 1

Production of Intermediate Transfer Member

<<Base Layer>>

—Preparation of Base Layer-Coating Liquid A—

First, carbon black (product of Evonik Degussa, trade name "Special Black 4") was dispersed in N-methyl-2-pyrrolidone with a bead mill. The resultant dispersion liquid was added to polyimide varnish mainly containing a polyimide resin precursor (product of UBE INDUSTRIES, LTD., trade name "U-varnish A") so that the carbon black content was adjusted to 17% by mass of the solid content of polyamic acid, followed by thoroughly stirring and mixing, to thereby prepare a base layer-coating liquid A.

—Formation of Base Layer—

Next, a metal cylinder (outer diameter: 340 mm, length: 300 mm) was subjected to blast treatment so as to have a rough surface, and then used as a mold. While the resultant cylindrical mold was being rotated at 50 rpm, the above base layer-coating liquid A was uniformly flow-cast over the outer surface of the cylindrical mold using a dispenser. At the point when all of a predetermined amount of the coating liquid was flow-cast and then uniformly spread on the outer surface of the cylindrical mold, the rotation speed was increased to 100 rpm. The resultant cylindrical mold was placed in a hot air-circulating dryer, and gradually heated to 110° C., followed by heating for 60 min. Moreover, the cylindrical mold was further heated to 200° C., followed by heating for 20 min. Subsequently, the rotation was stopped, and then the cylindrical mold was gradually cooled and taken out from the dryer. Thereafter, the cylindrical mold was placed in a heating furnace (baking furnace) which could perform high-temperature treatment, and was heated (baked) stepwise to 320° C., followed by heating (baking) for 60 min, to thereby form a base layer having a thickness of 60 μm.

<<Elastic Layer>>

—Preparation of Elastic Layer-Coating Liquid A—

After the cylindrical mold had been thoroughly cooled, the materials listed in Table 1 were mixed together and thoroughly kneaded with a biaxial kneader to prepare an elastic layer-coating liquid A.

TABLE 1

| Compound name | Trade name | Amount (parts by mass) |
|---|---|---|
| Acrylonitrile butadiene rubber (NBR) | Nipol DN003 (ZEON CORPORATION) | 100 |
| Carbon black | MA77 (Mitsubishi Chemical Corporation) | 4 |
| Zinc oxide | Pazet CK (Hakusuitech Ltd.) | 3 |
| Sulfur | Sulfax PS (Tsurumi chemical Co.) | 1 |
| 2-Heptanone | (KYOWA HAKKO CHEMICAL CO., LTD.) | 200 |

—Formation of Elastic Layer—

Similarly, the above elastic layer-coating liquid A was uniformly flow-cast on the above-formed base layer with a dispenser while the metal mold was being rotated. The coating amount was set so that the final layer thickness was adjusted to 400 μm. Thereafter, the metal mold was placed in a hot air-circulating dryer while being rotated. Then, the metal mold was heated to 90° C. at a temperature increasing rate of 4° C./min, followed by heating for 30 min. Furthermore, the metal mold was heated to 150° C. at a temperature increasing rate of 4° C./min, followed by heating for 60 min, to thereby form an elastic layer.

<Particle Layer>

—Formation of Particle Layer—

After the metal mold had been thoroughly cooled, silicone particles (product of Momentive Performance Materials Inc., trade name "TOSPEARL 120" (volume average particle diameter: 2.0 μm)), serving as the fine spherical particles, were uniformly applied to the surface in a manner shown in FIG. 3. Then, a polyurethane rubber blade (serving as the press member) was pressed against the particles to fix the particles on the elastic layer, to thereby form a particle layer.

Then, the resultant laminate was separated from the metal mold to thereby form an intermediate transfer member A as a seamless belt.

<Measurement of Martens Hardness of Intermediate Transfer Member>

The Martens hardness (HM) of the intermediate transfer member was measured with FisherScopeHM2000LT (product of Fischer Instruments, Co.) with measurement parameters set to "F=40 mN/10 sec (dF/dt=constant), C=10 sec, R=F." Separately, the intermediate transfer member was cut so as to have a square of about 1 cm×about 1 cm, to thereby prepare an intermediate transfer member sample. The reverse side of the sample was made to adhere to a glass slide with an instant adhesive. The sample on the glass slide was measured for Martens hardness under the above conditions. Notably, the indenter used was a Vickers quadrilateral diamond indenter.

<Measurement of Elastic Recovery Rate of Intermediate Transfer Member>

The elastic recovery rate (ηIT) of the intermediate transfer member was measured with the same method as the method for the Martens hardness (HM) of the intermediate transfer member.

<Measurement of Embedment Rate of Fine Spherical Particles in Intermediate Transfer Member>

The embedment rate of the fine spherical particles in the intermediate transfer member was measured as follows. Specifically, the cross-sectional surface of the intermediate transfer member was observed under a scanning electron microscope (SEM); ten arbitrary fine spherical particles in the intermediate transfer member were selected; each of the selected ten fine spherical particles was measured for the total volume thereof and the volume of part thereof embedded in the elastic layer (the volume of the embedded part); the measured volumes were used to calculate the ratio of the volume of the embedded part to the total volume (i.e., the volume of the embedded part/the total volume); and the ratios of the ten fine spherical particles were averaged to obtain an average embedment rate. The embedment rate was adjusted by adjusting the pressing time of the press member.

In the obtained intermediate transfer member A, the Martens hardness was 0.40 N/mm$^2$, the elastic recovery rate was 92%, and the embedment rate of the fine spherical particles was 50%.

Example 2

Production of Intermediate Transfer Member

The procedure of Example 1 was repeated, except that the embedment rate of the particles was adjusted to 35%, to thereby produce an intermediate transfer member B as a seamless belt. In the obtained intermediate transfer member B, the Martens hardness was 0.40 N/mm$^2$ and the elastic recovery rate was 92%.

Example 3

Production of Intermediate Transfer Member

The procedure of Example 1 was repeated, except that the embedment rate of the particles was adjusted to 95%, to thereby produce an intermediate transfer member C as a seamless belt. In the obtained intermediate transfer member C, the Martens hardness was 0.40 N/mm$^2$ and the elastic recovery rate was 92%.

Example 4

Production of Intermediate Transfer Member

The procedure of Example 1 was repeated, except that the silicone particles were changed to acryl particles (product of SEKISUI PLASTICS CO., LTD., trade name "Techno Polymer MBX-SS" (volume average particle diameter: 1 μm)) in the formation of the particle layer, to thereby produce an intermediate transfer member D as a seamless belt. In the obtained intermediate transfer member D, the Martens hardness was 0.39 N/mm$^2$, the elastic recovery rate was 91%, and the embedment rate of the fine spherical particles was 50%.

Example 5

Production of Intermediate Transfer Member

The procedure of Example 1 was repeated, except that the silicone particles (product of Momentive Performance Materials Inc., trade name "TOSPEARL 120" (volume average particle diameter: 2.0 μm)) were changed to silicone particles (product of Momentive Performance Materials Inc., trade name "TOSPEARL 145" (volume average particle diameter: 4.7 μm)) in the formation of the particle layer, to thereby produce an intermediate transfer member E as a seamless belt. In the obtained intermediate transfer member E, the Martens hardness was 0.41 N/mm$^2$, the elastic recovery rate was 93%, and the embedment rate of the fine spherical particles was 50%.

Example 6

Production of Intermediate Transfer Member

The procedure of Example 1 was repeated, except that the silicone particles (product of Momentive Performance Materials Inc., trade name "TOSPEARL 120" (volume average particle diameter: 2.0 μm)) were changed to silicone particles (product of Momentive Performance Materials Inc., trade name "TOSPEARL 2000B" (volume average particle diameter: 6.7 μm)) in the formation of the particle layer, to thereby produce an intermediate transfer member F as a seamless belt. In the obtained intermediate transfer member F, the Martens hardness was 0.42 N/mm$^2$, the elastic recovery rate was 88%, and the embedment rate of the fine spherical particles was 50%.

Example 7

Production of Intermediate Transfer Member

The procedure of Example 1 was repeated, except that the elastic layer-coating liquid A was changed to an elastic layer-coating liquid B, to thereby produce an intermediate transfer member G.

<<Elastic Layer>>

—Preparation of Elastic Layer-Coating Liquid B—

The materials listed in Table 2 were mixed together and thoroughly kneaded with a biaxial kneader to prepare an elastic layer-coating liquid B.

TABLE 2

| Compound name | Trade name | Amount (parts by mass) |
|---|---|---|
| Epoxy-silicone copolymer | ALBIFLEX348 (Nanoresins Co.) | 100 |
| Tetrahydro-methylphtalic anhydride | HN-2200 (Hitachi Chemical Co., Ltd.) | 15 |
| 2-Phenylimidazole | (KANTO CHEMICAL CO., INC.) | 0.5 |
| Carbon black | Regal330R (Cabot Corporation) | 10 |
| Methyl ethyl ketone | (KANTO CHEMICAL CO., INC.) | 30 |
| Cyclohexanone | (KANTO CHEMICAL CO., INC.) | 50 |

—Formation of Elastic Layer—

In the same manner as in the formation of the base layer, the elastic layer-coating liquid B was uniformly flow-cast on the previously-formed base layer with a dispenser while the metal mold was being rotated. The coating amount was set so that the final layer thickness was adjusted to 400 μm. Thereafter, the metal mold was placed in a hot air-circulating dryer while being rotated. Then, the metal mold was heated to 120° C. at a temperature increasing rate of 4° C./min, followed by heating for 30 min. Furthermore, the metal mold was heated to 200° C. at a temperature increasing rate of 4° C./min, followed by heating for 60 min, to thereby form an elastic layer.

In the obtained intermediate transfer member G, the Martens hardness was 0.92 N/mm$^2$, the elastic recovery rate was 78%, and the embedment rate of the fine spherical particles was 50%.

Example 8

Production of Intermediate Transfer Member

The procedure of Example 1 was repeated, except that the thickness of the elastic layer was adjusted to 2,100 μm in the formation of the elastic layer, to thereby produce an intermediate transfer member H as a seamless belt. In the obtained intermediate transfer member H, the Martens hardness was 0.43 N/mm$^2$, the elastic recovery rate was 95%, and the embedment rate of the fine spherical particles was 50%.

Example 9

Production of Intermediate Transfer Member

The procedure of Example 1 was repeated, the thickness of the elastic layer was adjusted to 180 μm in the formation of the elastic layer, to thereby produce an intermediate transfer member I as a seamless belt. In the obtained intermediate transfer member I, the Martens hardness was 0.52 N/mm$^2$, the elastic recovery rate was 79%, and the embedment rate of the fine spherical particles was 50%.

Example 10

Production of Intermediate Transfer Member

The procedure of Example 1 was repeated, except that the base layer-coating liquid A was changed to a base layer-coating liquid B, to thereby produce an intermediate transfer member J as a seamless belt.

—Preparation of Base Layer-Coating Liquid B—

First, carbon black (product of Mitsubishi Chemical Corporation, trade name "MA77") was dispersed in N-methyl-2-pyrrolidone with a bead mill. The resultant dispersion liquid was added to polyamideimide varnish mainly containing a polyamideimide resin precursor (product of TOYOBO CO., LTD., trade name "VYLOMAX HR-16NN") so that the carbon black content was adjusted to 22% by mass of the solid content of polyamic acid, followed by thoroughly stirring and mixing, to thereby prepare a base layer-coating liquid B.

—Formation of Base Layer—

Next, a metal cylinder (outer diameter: 340 mm, length: 300 mm) was subjected to blast treatment so as to have a rough surface, and then used as a metal mold. While the resultant cylindrical mold was being rotated at 50 rpm, the above base layer-coating liquid B was uniformly flow-cast over the outer surface of the cylindrical mold using a dispenser. At the point when all of a predetermined amount of the coating liquid was flow-cast and then uniformly spread on the outer surface of the cylindrical mold, the rotation speed was increased to 100 rpm. The resultant cylindrical mold was placed in a hot air-circulating dryer, and gradually heated to 110° C., followed by heating for 60 min. Subsequently, the rotation was stopped and then the cylindrical mold was gradually cooled. The cylindrical mold having a film was taken out from the dryer. Thereafter, the cylindrical mold was placed in a heating furnace (baking furnace) which could perform high-temperature treatment, and was heated (baked) stepwise to 250° C., followed by heating (baking) for 60 min, to thereby form a base layer having a thickness of 60 μm.

In the obtained intermediate transfer member J, the Martens hardness was 0.40 N/mm$^2$, the elastic recovery rate was 92%, and the embedment rate of the fine spherical particles was 50%.

Example 11

Production of Intermediate Transfer Member

The procedure of Example 1 was repeated, except that the silicone particles were changed to spherical PMMA particles (product of SEKISUI PLASTICS CO., LTD., trade name "Techno Polymer XX-17FM" (volume average particle diameter: 0.1 μm)) in the formation of the particle layer, to thereby form an intermediate transfer member K in the seamless belt. In the obtained intermediate transfer member K, the Martens hardness was 0.38 N/mm$^2$, the elastic recovery rate was 93%, and the embedment rate of the fine spherical particles was 50%.

Comparative Example 1

Production of Intermediate Transfer Member

The procedure of Example 1 was repeated, except that the embedment rate of the particles was adjusted to 25%, to thereby produce an intermediate transfer member L as a seamless belt. In the obtained intermediate transfer member L, the Martens hardness was 0.40 N/mm$^2$ and the elastic recovery rate was 92%.

Comparative Example 2

Production of Intermediate Transfer Member

The procedure of Example 1 was repeated, except that the elastic layer was formed as follows, to thereby produce an intermediate transfer member M as a seamless belt.

<<Elastic Layer>>

—Preparation of Elastic Layer-Coating Liquid C—

The materials listed in Table 3 were mixed together and thoroughly kneaded with a biaxial kneader to prepare an elastic layer-coating liquid C.

TABLE 3

| Compound name | Trade name | Amount (parts by mass) |
|---|---|---|
| Polyurethane elastomer | RUP1627 (DIC Corporation) | 100 |
| Curing agent | CLM-1 (DIC Corporation) | 2 |
| Curing agent | CLM-5 (DIC Corporation) | 2 |
| Ion conductive agent | PEL-20A (Japan Carlit Co., Ltd.) | 0.1 |
| Toluene | (KANTO CHEMICAL CO., INC.) | 200 |

—Formation of Elastic Layer—

In the same manner as in the formation of the base layer, the elastic layer-coating liquid C was uniformly flow-cast on the previously-formed base layer with a dispenser while the metal mold was being rotated. The coating amount was set so that the final layer thickness was adjusted to 400 μm. Thereafter, the metal mold was placed in a hot air-circulating dryer while being rotated. Then, the metal mold was heated to 110° C. at a temperature increasing rate of 3° C./min, followed by heating for 30 min. Furthermore, the metal mold was heated to 150° C. at a temperature increasing rate of 3° C./min, followed by heating for 60 min, to thereby form an elastic layer.

In the obtained intermediate transfer member M, the Martens hardness was 1.24 N/mm$^2$, the elastic recovery rate was 88%, and the embedment rate of the fine spherical particles was 50%.

Comparative Example 3

Production of Intermediate Transfer Member

The procedure of Example 1 was repeated, except that the elastic layer was formed as follows, to thereby produce an intermediate transfer member N as a seamless belt.

<<Elastic Layer>>

—Preparation of Elastic Layer-Coating Liquid D—

The materials listed in Table 4 were mixed together and thoroughly kneaded with a biaxial kneader to prepare an elastic layer-coating liquid D.

TABLE 4

| Compound name | Trade name | Amount (parts by mass) |
|---|---|---|
| Polyurethane elastomer | RUP1627 (DIC Corporation) | 100 |
| Curing agent | CLM-1 (DIC Corporation) | 2 |
| Curing agent | CLM-5 (DIC Corporation) | 2 |
| Ion conductive agent | PEL-20A (Japan Carlit Co., Ltd.) | 0.07 |
| Liquid NBR | Nipol1312 (ZEON CORPORATION) | 70 |
| Toluene | (KANTO CHEMICAL CO., INC.) | 300 |

—Formation of Elastic Layer—

In the same manner as in the formation of the base layer, the elastic layer-coating liquid D was uniformly flow-cast on the previously-formed base layer with a dispenser while the metal mold was being rotated. The coating amount was set so that the final layer thickness was adjusted to 400 μm. Thereafter, the metal mold was placed in a hot air-circulating dryer while being rotated. Then, the metal mold was heated to 110° C. at a temperature increasing rate of 3° C./min, followed by heating for 30 min. Furthermore, the metal mold was heated to 150° C. at a temperature increasing rate of 3° C./min, followed by heating for 60 min, to thereby form an elastic layer.

In the obtained intermediate transfer member N, the Martens hardness was 0.34 N/mm$^2$, the elastic recovery rate was 69%, and the embedment rate of the fine spherical particles was 50%.

Comparative Example 4

Production of Intermediate Transfer Member

The procedure of Example 1 was repeated, except that the silicone particles were changed to a silicone adhesive (product of Dow Corning Toray, Co., Ltd., trade name "SD4580PSA") and the silicone adhesive was applied and dried so as to have a thickness of 0.2 μm in the formation of the particle layer, to thereby produce an intermediate transfer member O as a seamless belt. In the obtained intermediate transfer member O, the Martens hardness was 0.88 N/mm$^2$ and the elastic recovery rate was 74%.

Comparative Example 5

Production of Intermediate Transfer Member

The procedure of Example 1 was repeated, except that no particle layer was formed, to thereby produce an intermediate transfer member P as a seamless belt. In the obtained intermediate transfer member P, the Martens hardness was 0.38 N/mm$^2$ and the elastic recovery rate was 93%.

Example 12

The procedure of Example 1 was repeated, except that the thickness of the elastic layer was adjusted to 2,000 μm in the formation of the elastic layer, to thereby produce an intermediate transfer member Q as a seamless belt. In the obtained intermediate transfer member Q, the Martens hardness was 0.44 N/mm$^2$, the elastic recovery rate was 94%, and the embedment rate of the fine spherical particles was 50%.

Example 13

The procedure of Example 1 was repeated, except that the thickness of the elastic layer was adjusted to 200 μm in the formation of the elastic layer, to thereby produce an intermediate transfer member R as a seamless belt. In the obtained intermediate transfer member R, the Martens hardness was 0.49N/mm$^2$, the elastic recovery rate was 81%, and the embedment rate of the fine spherical particles was 50%

Examples 1 to 11 and Comparative Examples 1 to 5

Evaluation

Each of the intermediate transfer members of Examples 1 to 11 and Comparative Examples 1 to 5 was mounted to an image forming apparatus shown in FIG. 4, and was evaluated as follows.

<<Measurement of Secondary Transfer Rate>>

The transfer paper used was paper having irregularities in its surface (LEATHAC 66, 215 kg paper). A solid blue image was output on the transfer paper using the image forming apparatus. Then, the amount of the toner present on the intermediate transfer member before the toner was transferred onto the paper and the amount of the toner remaining on the intermediate transfer member after the toner had been transferred onto the paper were measured, and a transfer rate was calculated from these amounts.

Secondary transfer rate (%)=((amount of toner present on intermediate transfer member after transfer (*g*))/(amount of toner present on intermediate transfer member before transfer (*g*)))×100

<<Measurement of Transfer Rate after 10,000 Sheets Continuous Printing>>

A test chart was continuously printed on 10,000 sheets, and then printing was terminated. The transfer rate was measured with the same method as the method for measuring the secondary transfer rate.

<<Image Evaluation after 10,000 Sheets Continuous Printing>>

A test chart was continuously printed on 10,000 sheets. Then, a halftone image of monotonic cyan was printed to observe the occurrence of image failures.

<<Observation for Exfoliation of Particles after 10,000 Sheets Continuous Printing>>

After the above image evaluation, the belt surface was observed at any position under a scanning electron microscope (SEM) in terms of whether the particles were exfoliated or not.

Table 5 shows the materials of the intermediate transfer members of Examples 1 to 11 and Comparative Examples 1 to 5. Table 6 shows the results of the above-described various evaluations.

TABLE 5

| | | Base layer | Elastic layer | | Particle layer | | | Intermediate transfer member | |
|---|---|---|---|---|---|---|---|---|---|
| | | Base layer-coating liquid | Elastic layer-coating liquid | Thickness (μm) | Fine spherical particles | Avg. particle diameter (μm) | Embedment rate (%) | Elastic recovery rate (%) | Martens hardness (N/mm$^2$) |
| Ex. 1 | A | A | A | 400 | Silicone | 2 | 50 | 92 | 0.4 |
| Ex. 2 | B | A | A | 400 | Silicone | 2 | 35 | 92 | 0.4 |
| Ex. 3 | C | A | A | 400 | Silicone | 2 | 95 | 92 | 0.4 |
| Ex. 4 | D | A | A | 400 | Acryl | 1 | 50 | 91 | 0.39 |
| Ex. 5 | E | A | A | 400 | Silicone | 4.7 | 50 | 93 | 0.41 |
| Ex. 6 | F | A | A | 400 | Silicone | 6.7 | 50 | 88 | 0.42 |
| Ex. 7 | G | A | B | 400 | Silicone | 2 | 50 | 78 | 0.92 |
| Ex. 8 | H | A | A | 2,100 | Silicone | 2 | 50 | 95 | 0.43 |
| Ex. 9 | I | A | A | 180 | Silicone | 2 | 50 | 79 | 0.52 |
| Ex. 10 | J | B | A | 400 | Silicone | 2 | 50 | 92 | 0.4 |
| Ex. 11 | K | A | A | 400 | Silica | 0.1 | 50 | 93 | 0.38 |
| Comp. Ex. 1 | L | A | A | 400 | Silicone | 2 | 25 | 92 | 0.4 |
| Comp. Ex. 2 | M | A | C | 400 | Silicone | 2 | 50 | 88 | 1.24 |
| Comp. Ex. 3 | N | A | D | 400 | Silicone | 2 | 50 | 69 | 0.34 |
| Comp. Ex. 4 | O | A | A | 400 | Silicone adhesive | — | — | 74 | 0.88 |
| Comp. Ex. 5 | P | A | A | 400 | — | — | — | 93 | 0.38 |
| Ex. 12 | Q | A | A | 2000 | Silicone | 2 | 50 | 94 | 0.44 |
| Ex. 13 | R | A | A | 200 | Silicone | 2 | 50 | 81 | 0.49 |

TABLE 6

| | | Initial | After 10,000 sheets printing | | | |
|---|---|---|---|---|---|---|
| | | Transfer rate (%) | Transfer rate (%) | Image failures | Other failures | Exfoliation of particles |
| Ex. 1 | A | 93.8 | 93.8 | None | None | None |
| Ex. 2 | B | 93.7 | 93.6 | None | None | None |
| Ex. 3 | C | 93.1 | 92.7 | None | None | None |
| Ex. 4 | D | 92.8 | 92.8 | None | None | None |
| Ex. 5 | E | 93.5 | 93.1 | None | None | None |
| Ex. 6 | F | 92.4 | 91.9 | None | None | None |
| Ex. 7 | G | 90.5 | 89.3 | None | None | Only a few particles were exfoliated |
| Ex. 8 | H | 90.1 | 85.9 | None | None | Only a few particles were exfoliated |
| Ex. 9 | I | 88.8 | 84.4 | None | None | Only a few particles were exfoliated |
| Ex. 10 | J | 93.8 | 93.8 | None | None | None |
| Ex. 11 | K | 90.3 | 82.4 | Ununiform image density was observed in some parts | Scratches were formed on photoconductor | Some particles were exfoliated |
| Comp. Ex. 1 | L | 93.7 | 62.1 | Ununiform image density was observed | Cleaning failures were observed in some parts | Particles were exfoliated |
| Comp. Ex. 2 | M | 79.8 | 72.4 | Ununiform image density was observed | Cleaning failures were observed in some parts | Some particles were exfoliated |
| Comp. Ex. 3 | N | 83.8 | 80.3 | Streaky ununiform image density was observed | None | None |
| Comp. Ex. 4 | O | 68.8 | 68.8 | Image density was low | Cleaning failures were observed in some parts | None |
| Comp. Ex. 5 | P | 23.1 | 24.7 | Image density was low | Cleaning failures were observed in the entirety | — |
| Ex. 12 | Q | 90.1 | 88.7 | None | None | None |
| Ex. 13 | R | 89.5 | 86.0 | None | None | None |

From the above results, the intermediate transfer member having the configuration of the present invention was found to realize an image forming apparatus that can attain high transfer rate regardless of the type of a transfer medium, has high durability, and can form high-quality images for a long period of time.

The layer structure of the present invention has flexibility, is excellent in releaseability to toner, realizes high transfer performance regardless of the type of a transfer medium and surface conditions thereof, involves no exfoliation of particles for a long period of time, does no damage to an organic photoconductor, and can stably form high-quality images. Thus, for example, it can be used for image forming apparatuses suitably used for electrophotographic copiers, printers and facsimiles, and can also be suitably used as an intermediate transfer member used in them.

This application claims priority to Japanese patent application No. 2010-224340, filed on Oct. 1, 2010, and incorporated herein by reference.

What is claimed is:

1. An intermediate transfer member comprising:

a base layer serving as a first layer, an elastic layer serving as a second layer, and a particle layer serving as a third layer and containing fine spherical particles arranged in a plane direction of the particle layer where the particle layer has a concavo-convex pattern formed by the fine spherical particles, the elastic layer and the particle layer being formed on the base layer in this order, wherein the intermediate transfer member has a Martens hardness of 1.0 N/mm$^2$ or lower and an elastic recovery rate of 75% or higher when the intermediate transfer member is indented at a load of 40 mN under conditions of 25° C. and 50% RH, wherein an embedment rate of the fine spherical particles in the elastic layer is 33% to 99%, and wherein the intermediate transfer member is configured to receive a toner image formed by developing, with a toner, a latent image on an image bearing member.

2. The intermediate transfer member according to claim 1, wherein the fine spherical particles are silicone particles.

3. The intermediate transfer member according to claim 1, wherein the fine spherical particles have a volume average particle diameter of 0.5 μm to 5.0 μm.

4. The intermediate transfer member according to claim 1, wherein the elastic layer is formed of at least one selected from an elastomer and a rubber.

5. The intermediate transfer member according to claim 1, wherein the elastic layer has a thickness of 200 μm to 2,000 μm.

6. The intermediate transfer member according to claim 1, wherein the base layer is formed of at least one selected from a polyimide resin and a polyamideimide resin.

7. An image forming apparatus comprising:

an image bearing member configured to form a latent image thereon and bear a toner image, a developing unit configured to develop with a toner the latent image formed on the image bearing member to form the toner image, an intermediate transfer member onto which the toner image developed with the developing unit is primarily transferred, a transfer unit configured to secondarily transfer onto a recording medium the toner image transferred onto the intermediate transfer member, wherein the intermediate transfer member comprises:

a base layer serving as a first layer, an elastic layer serving as a second layer, and a particle layer serving as a third layer and containing fine spherical particles arranged in a plane direction of the particle layer where the particle layer has a concavo-convex pattern formed by the fine spherical particles, the elastic layer and the particle layer being formed on the base layer in this order, wherein the intermediate transfer member has a Martens hardness of 1.0 $N/mm^2$ or lower and an elastic recovery rate of 75% or higher when the intermediate transfer member is indented at a load of 40 mN under conditions of 25° C. and 50% RH, wherein an embedment rate of the fine spherical particles in the elastic layer is 33% to 99%, and wherein the intermediate transfer member is configured to receive the toner image formed by developing, with the toner, the latent image on the image bearing member.

8. The image forming apparatus according to claim 7, wherein the image forming apparatus is a full-color image forming apparatus where a plurality of the image bearing members each having the developing unit for each color are arranged in series.

* * * * *